US011214059B2

(12) United States Patent
Nakagawa et al.

(10) Patent No.: US 11,214,059 B2
(45) Date of Patent: Jan. 4, 2022

(54) LIQUID EJECTION HEAD, LIQUID EJECTION APPARATUS AND LIQUID EJECTION MODULE

(71) Applicant: CANON KABUSHIKI KAISHA, Tokyo (JP)

(72) Inventors: Yoshiyuki Nakagawa, Kawasaki (JP); Akiko Hammura, Tokyo (JP); Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/944,266

(22) Filed: Jul. 31, 2020

(65) Prior Publication Data

US 2021/0046756 A1 Feb. 18, 2021

(30) Foreign Application Priority Data

Aug. 13, 2019 (JP) ..... JP2019-148516

(51) Int. Cl.
*B41J 2/14* (2006.01)
*B41J 2/045* (2006.01)
*B41J 2/18* (2006.01)

(52) U.S. Cl.
CPC ..... *B41J 2/14016* (2013.01); *B41J 2/0458* (2013.01); *B41J 2/18* (2013.01)

(58) Field of Classification Search
CPC ..... B41J 2/14016; B41J 2/0458; B41J 2/18
See application file for complete search history.

(56) References Cited

U.S. PATENT DOCUMENTS

2010/0238232 A1* 9/2010 Clarke ..... B01J 13/02 347/21
2020/0039210 A1 2/2020 Nakagawa et al.
2020/0039218 A1 2/2020 Nakagawa et al.
2020/0039219 A1 2/2020 Nakagawa et al.
2020/0039223 A1 2/2020 Nakagawa et al.
2020/0262200 A1 8/2020 Nakagawa et al.
2020/0262201 A1 8/2020 Nakagawa et al.

FOREIGN PATENT DOCUMENTS

JP 06-305143 A 11/1994

OTHER PUBLICATIONS

U.S. Appl. No. 16/944,274, Yoshiyuki Nakagawa Akiko Hammura, Jul. 31, 2020.

* cited by examiner

*Primary Examiner* — Thinh H Nguyen
(74) *Attorney, Agent, or Firm* — Venable LLP

(57) ABSTRACT

A liquid ejection head includes a liquid channel through which a first liquid and a second liquid flow in a predetermined direction, a first inlet port through which the first liquid flows into the liquid channel, a second inlet port through which the second liquid flows into the liquid channel, a pressure generation element which pressurizes the first liquid and an ejection orifice through which the second liquid is ejected by pressure received from the first liquid pressurized by the pressure generation element. A length of flow of the second liquid from the second inlet port to a position at which the second liquid is ejectable from the ejection orifice is shorter than a length of flow of the first liquid from the first inlet port to the position at which the second liquid is ejectable.

19 Claims, 17 Drawing Sheets

LIQUID EJECTION HEAD, LIQUID EJECTION APPARATUS AND LIQUID EJECTION MODULE

BACKGROUND OF THE DISCLOSURE

Field of the Disclosure

The present disclosure relates to a liquid ejection head, a liquid ejection apparatus and a liquid ejection module.

Description of the Related Art

Japanese Patent Laid-Open No. H06-305143 discloses a liquid ejection unit in which a liquid as an ejection medium and a liquid as a bubble generation medium are brought into contact with each other at an interface and the ejection medium is ejected by means of growth of a bubble generated in the bubble generation medium by applying thermal energy. According to Japanese Patent Laid-Open No. H06-305143, a method is described in which, after the ejection of the ejection medium, the ejection medium and the bubble generation medium are pressurized to form a flow in a liquid channel so as to make the interface between the ejection medium and the bubble generation medium stable inside the liquid channel.

SUMMARY OF THE DISCLOSURE

In a first aspect of the present invention, there is provided a liquid ejection head comprising: a liquid channel which is formed by laminating a substrate and a channel forming member and through which a first liquid and a second liquid are caused to flow in a predetermined direction; a first inlet port through which the first liquid is caused to flow into the liquid channel; a second inlet port through which the second liquid is caused to flow into the liquid channel; a pressure generation element which is disposed in the substrate and pressurizes the first liquid; and an ejection orifice which is formed in the channel forming member and through which the second liquid is ejected in a direction crossing the predetermined direction by a pressure received from the first liquid pressurized by the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

In a second aspect of the present invention, there is provided a liquid ejection apparatus comprising: a liquid ejection head including a liquid channel which is formed by laminating a substrate and a channel forming member and through which a first liquid and a second liquid are caused to flow in a predetermined direction, a first inlet port through which the first liquid is caused to flow into the liquid channel, a second inlet port through which the second liquid is caused to flow into the liquid channel, a pressure generation element which is disposed in the substrate and pressurizes the first liquid, and an ejection orifice which is formed in the channel forming member and through which the second liquid is ejected in a direction crossing the predetermined direction by a pressure received from the first liquid pressurized by the pressure generation element, a flow control unit which controls the flow of the first liquid and the second liquid in the liquid channel; and a drive unit which drives the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

In a third aspect of the present invention, there is provided a liquid ejection module that forms a liquid ejection head by being arrayed with one or more of the liquid ejection modules, comprising: a liquid channel which is formed by laminating a substrate and a channel forming member and through which a first liquid and a second liquid are caused to flow in a predetermined direction; a first inlet port through which the first liquid is caused to flow into the liquid channel; a second inlet port through which the second liquid is caused to flow into the liquid channel; a pressure generation element which is disposed in the substrate and pressurizes the first liquid; and an ejection orifice which is formed in the channel forming member and through which the second liquid is ejected in a direction crossing the predetermined direction by a pressure received from the first liquid pressurized by the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

Further features of the present invention will become apparent from the following description of exemplary embodiments with reference to the attached drawings.

DESCRIPTION OF THE EMBODIMENTS

However, even though there is a description as to the flow inside the liquid channel around an ejection orifice in Japanese Patent Laid-Open No. H06-305143, there is no clear description as to a flow path of the ejection medium and the bubble generation medium to the ejection orifice. For this reason, recovering after ejection operation is not performed in time depending on the viscosity of the ejection medium or the flow resistance of the flow path. Thus, there may be a case where it is difficult to perform a fine ejection operation at a high frequency.

The present invention has been made for solving the above-mentioned problem. Accordingly, an object of the present invention is to provide a liquid ejection head having a liquid channel structure capable of performing a fine ejection operation at a high frequency in a configuration in which an ejection medium is ejected while causing the ejection medium and a bubble generation medium to flow.

First Embodiment (Configuration of Liquid Ejection Head)

Figure 1:
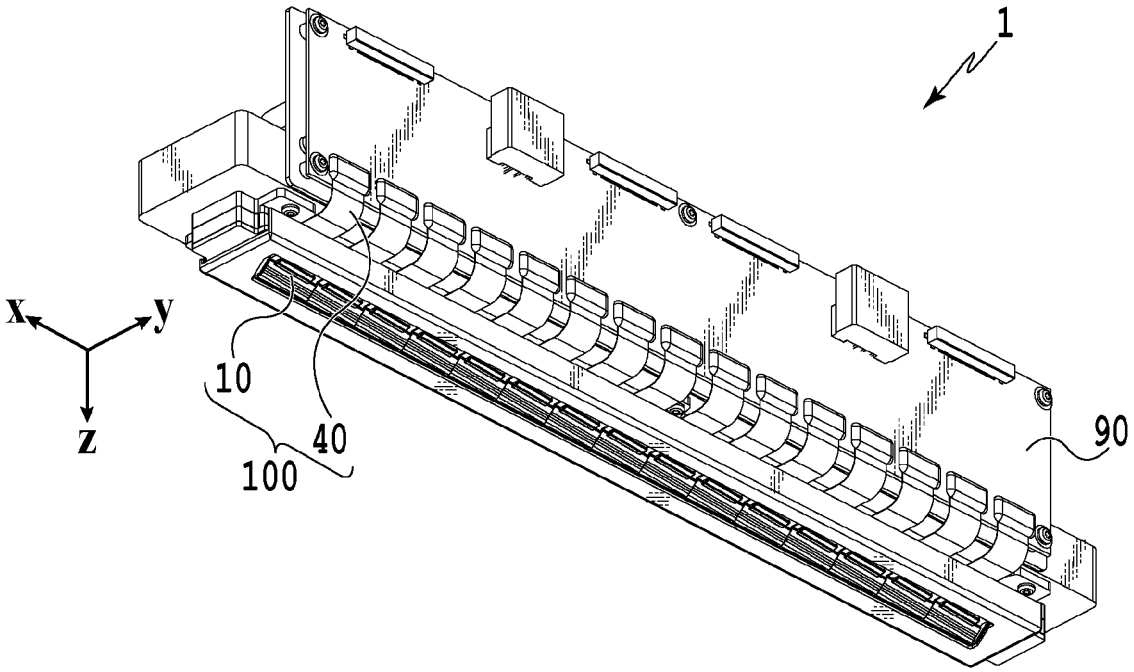
FIG. 1 is a perspective view of an ejection head.

FIG. 1 is a perspective view of a liquid ejection head 1 usable in a first embodiment. The liquid ejection head 1 in the present embodiment includes a plurality of liquid ejection modules 100 arrayed in an x direction. Each individual liquid ejection module 100 has an element substrate 10 in which a plurality of ejection elements are arrayed, and a flexible wiring substrate 40 for supplying power and an ejection signal to each individual ejection element. The flexible wiring substrates 40 are connected in common to an electrical wiring board 90 in which power supply terminals and ejection signal input terminals are disposed. The liquid ejection modules 100 are easily attachable to and detachable from the liquid ejection head 1. Thus, any liquid ejection modules 100 are easily attachable to and detachable from the liquid ejection head 1 from the outside without having to disassemble the liquid ejection head 1.

As described above, the liquid ejection head 1 includes a plurality of liquid ejection modules 100 arrayed in the longitudinal direction. Thus, even in a case where an ejection failure occurs in any of the election elements, only the liquid ejection module with the ejection failure needs to be replaced. This makes it possible to improve the yield of the manufacturing process of the liquid ejection head 1 and to reduce the cost of head replacement.

(Configuration of Liquid Ejection Apparatus)

Figure 2:
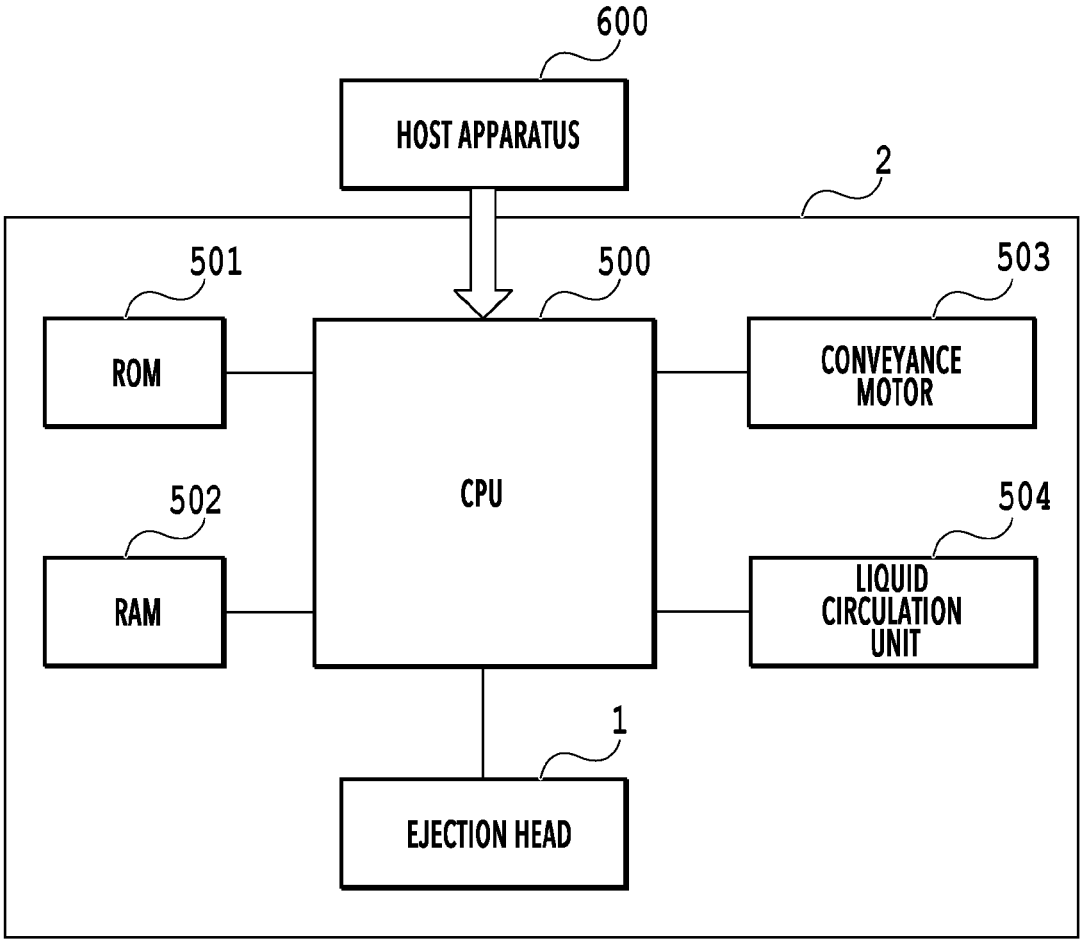
FIG. 2 is a block diagram for explaining a control configuration of a liquid ejection apparatus.

FIG. 2 is a block diagram illustrating a control configuration of a liquid ejection apparatus 2 usable in the present embodiment. A CPU 500 controls the entire liquid ejection apparatus 2 while using a RAM 502 as a work area in accordance with a program stored in a ROM 501. In an example, the CPU 500 performs predetermined data processing on ejection data received from a host apparatus 600 connected to the outside in accordance with the program and parameters stored in the ROM 501 to thereby generate ejection signals with which the liquid ejection head 1 can perform an ejection operation. Then, while driving the liquid ejection head 1 in accordance with this ejection signal, the CPU 500 drives a conveyance motor 503 to convey a liquid application target medium in a predetermined direction and thereby attach a liquid ejected from the liquid ejection head 1 to the application target medium.

A liquid circulation unit 504 is a unit that supplies liquids to the liquid ejection head 1 while circulating the liquids, and controls the flow of the liquids in the liquid ejection head 1. The liquid circulation unit 504 includes sub tanks which store the liquids, channels through which the liquids are circulated between the sub tanks and the liquid ejection head 1, a plurality of pumps, a flow rate adjustment unit which adjusts the flow rates of the liquids flowing through the ejection head 1, and so on. Under the instruction of the CPU 500, the liquid circulation unit 504 controls the above plurality of mechanisms such that the liquids flow through the liquid ejection head 1 at predetermined flow rates.

(Configuration of Element Substrate)

Figure 3:
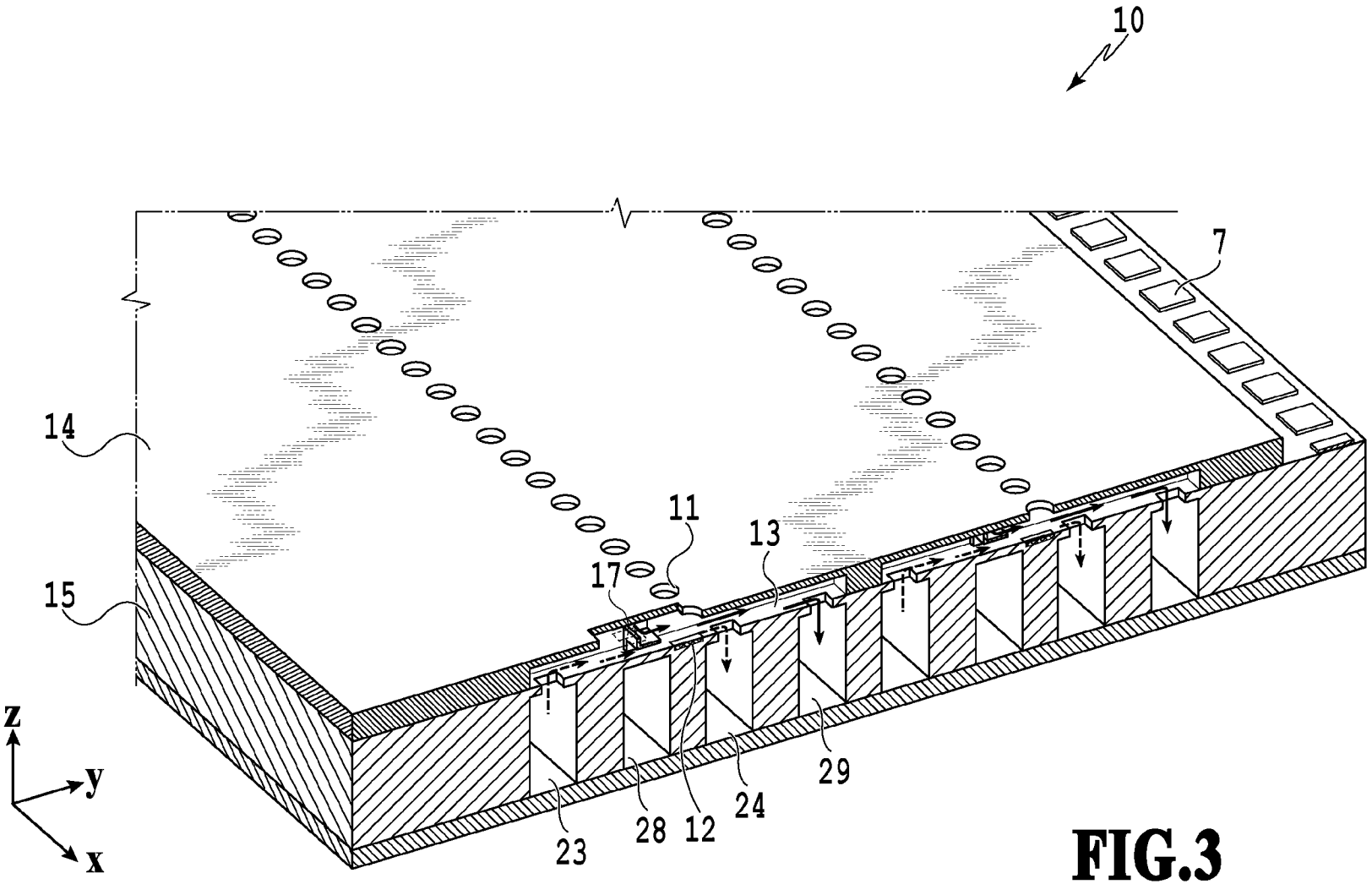
FIG. 3 is a perspective cross-sectional view of an element substrate in a liquid ejection module.

FIG. 3 is a perspective cross-sectional view of the element substrate 10 in the present embodiment provided to each individual liquid ejection module 100. The element substrate 10 includes a silicon (Si) substrate 15 and an orifice plate 14 (channel forming member) laminated on the silicon substrate 15. In FIG. 3, ejection orifices 11 arrayed in the x direction eject the same kind of liquid (e.g., a liquid supplied from a common sub tank or supply port). This diagram shows an example in which the orifice plate 14 includes structures inside liquid channels 13. However, the configuration may be such that the structures inside the liquid channels 13 are formed by another member (channel wall member), and the orifice plate 14 with the ejection orifices 11 formed therethrough is provided on top of that member.

Pressure generation elements 12 (not shown in FIG. 3) are disposed at positions on the silicon substrate 15 corresponding to the individual ejection orifices 11. The ejection orifices 11 and the pressure generation elements 12 are provided at positions opposite each other. Each pressure generation element 12 pressurizes a liquid in a z direction perpendicular to the flow direction (y direction) in a case where a voltage corresponding to an ejection signal is applied. As a result, the liquid is ejected in the form of a droplet from the ejection orifice 11 opposite the pressure generation element 12. The power and drive signal to the pressure generation element 12 are supplied from the flexible wiring substrate 40 (see FIG. 1) via a terminal 17 disposed on the silicon substrate 15.

In the orifice plate 14, a plurality of liquid channels 13 are formed which extend in the y direction and individually connect to the respective ejection orifices 11. Also, a plurality of liquid channels 13 arrayed in the x direction are connected in common to a first common supply channel 23, a first common collection channel 24, a second common supply channel 28, and a second common collection channel 29. The liquid flow in the first common supply channel 23, the first common collection channel 24, the second common supply channel 28, and the second common collection channel 29 is controlled by the liquid circulation unit 504 described with reference to FIG. 2. Specifically, the liquid flow is controlled such that a first liquid having flowed into the liquid channels 13 from the first common supply channel 23 flows toward the first common collection channel 24, and a second liquid having flowed into the liquid channels 13 from the second common supply channel 28 flows toward the second common collection channel 29.

FIG. 3 shows an example in which those ejection orifices 11 and liquid channels 13 arrayed in the x direction and the paired first and second common supply channels 23 and 28 and the paired first and second common collection channels 24 and 29 for supplying and collecting ink in common to and from the ejection orifices 11 and the liquid channels 13 are disposed in two rows in the y direction.

(Configuration of Liquid Channel and Pressure Chamber)

Figure 4A:
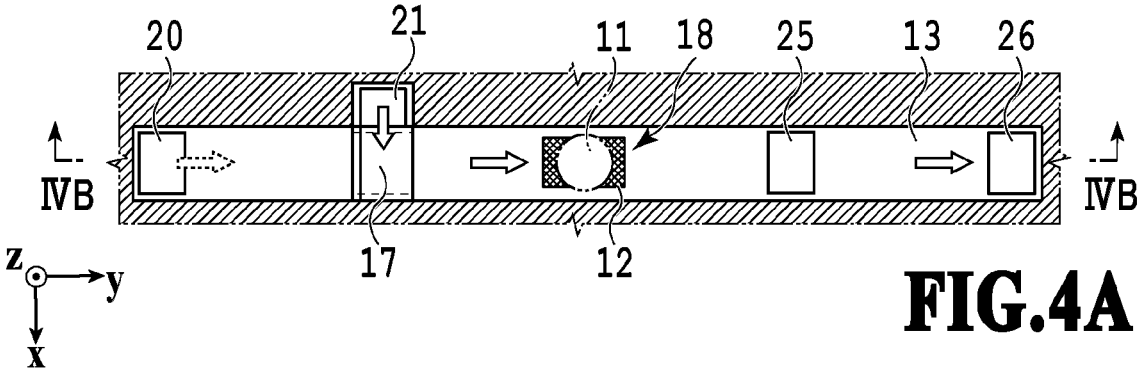
FIGS. 4A to 4D are diagrams for explaining a configuration of a liquid channel and a pressure chamber in a first embodiment.
Figure 4B:
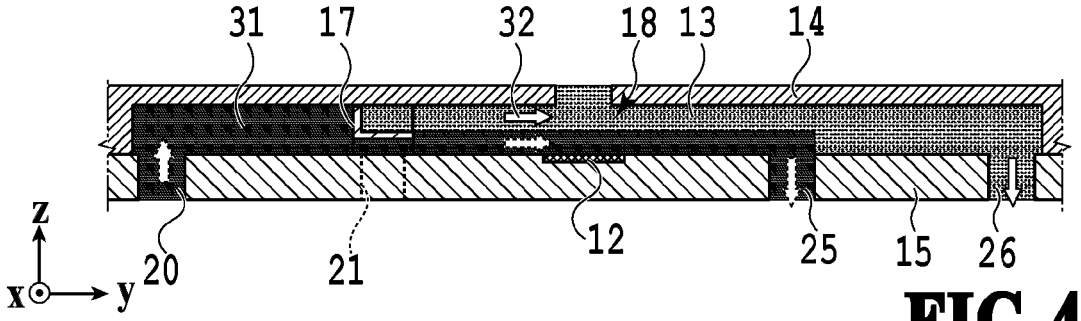
Figure 4C:
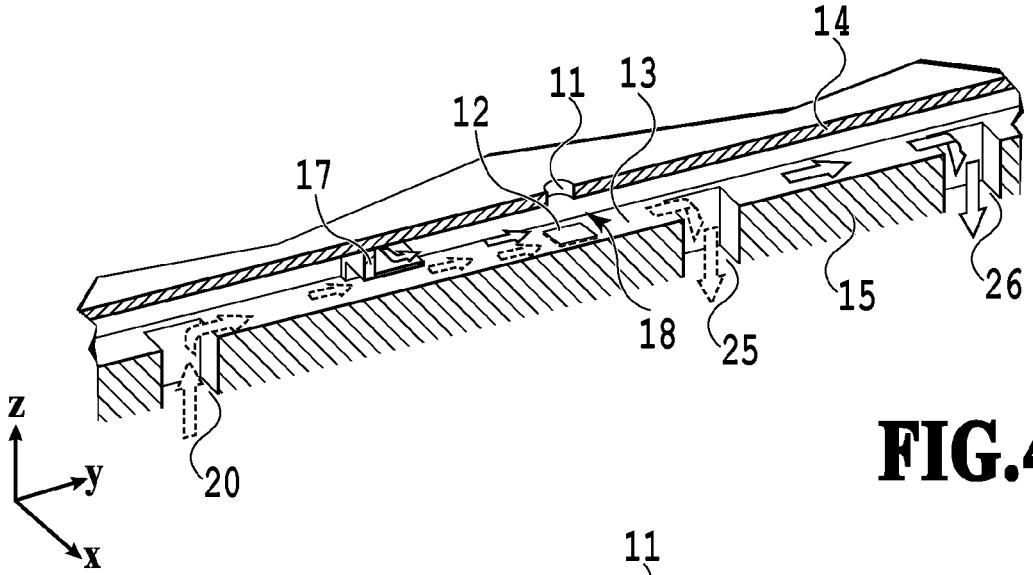
Figure 4D:
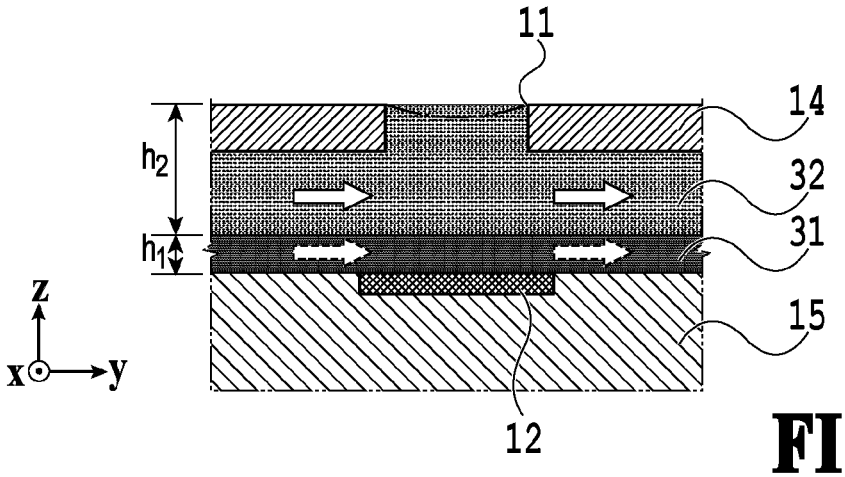

FIGS. 4A to 4D are diagrams for specifically explaining a configuration of one liquid channel 13 and one pressure chamber 18 formed in the element substrate 10 shown in FIG. 3. FIG. 4A is a transparent view from the ejection orifice 11 side (+z direction side), and FIG. 4B is a cross-sectional view taken along IVB-IVB line shown in FIG. 4A. Also, FIG. 4C is a perspective cross-sectional view of the element substrate 10. Further, FIG. 4D is an enlarged view of the ejection orifice 11 and its surroundings in FIG. 4B.

In a portion of the silicon substrate 15 corresponding to the bottom of the liquid channel 13, a first inlet port 20, a second inlet port 21, a first outlet port 25, and a second outlet port 26 having substantially the same width as that of the liquid channel 13 are formed in this order in the +y direction. The first inlet port 20, the second inlet port 21, the first outlet port 25, and the second outlet port 26 are connected to the first common supply channel 23, the second common supply channel 28, the first common collection channel 24, and the second common collection channel 29 shown in FIG. 3, respectively.

The pressure chamber 18, which is a region being a part of the liquid channel 13 and containing the ejection orifice 11 and the pressure generation element 12, is disposed substantially at the midpoint between the second inlet port 21 and the first outlet port 25 in the y direction. Among the first inlet port 20, the second inlet port 21, the pressure chamber 18, the first outlet port 25, and the second outlet port 26, the ports other than the second inlet port 21 are disposed on a single line extending in the y direction, and only the second inlet port 21 is disposed at a position offset from the above single line in the −x direction.

At the position where a second liquid 32 supplied from the second inlet port 21 flows into the liquid channel 13, a first structural member 17 is provided, dividing the liquid channel 13 vertically (±z direction). The first liquid 31 caused to flow into the liquid channel 13 from the first inlet port 20 advances in the +y direction through the liquid channel 13 and advances through the channel on the −z direction side of the first structural member 17 (hereinafter referred to as the lower channel). On the other hand, the flow direction of the second liquid 32 having entered the liquid channel 13 from the −x direction side is changed to the +y direction by the channel on the +z direction side of the first structural member 17 (hereinafter referred to as the upper channel). The first liquid 31 and the second liquid 32 advancing in the +y direction respectively through the upper channel and the lower channel over and under the first structural member 17 contact each other at the position of the end of the first structural member 17, thereby forming an interface therebetween, and reach the pressure chamber 18 in the form of parallel flows. After passing the pressure chamber 18, the first liquid 31 is caused to flow out from the first outlet port 25, and the second liquid 32 is caused to flow out from the second outlet port 26.

Inside the pressure chamber 18, the pressure generation element 12 is in contact with the first liquid 31, and the second liquid 32 around the ejection orifice 11 exposed to the atmosphere forms a meniscus. Inside the pressure chamber 18, the first liquid 31 and the second liquid 32 flow such that the pressure generation element 12, the first liquid 31, the second liquid 32, and the ejection orifice 11 are arranged in this order. In other words, assuming that the pressure generation element 12 side is the lower side and the ejection orifice 11 side is the upper side, the second liquid 32 flows over the first liquid 31. Further, the first liquid 31 and the second liquid 32 are pressurized by the pressure generation element 12 below them to thereby be ejected from the lower side toward the upper side. Meanwhile, this up-down direction is the height direction of the pressure chamber 18 and the liquid channel 13.

In the present embodiment, the flow rate of the first liquid 31 and the flow rate of the second liquid 32 are adjusted according to physical properties of the first liquid 31 and physical properties of the second liquid 32 such that the first liquid 31 and the second liquid 32 flow as parallel flows moving alongside and in contact with each other inside the pressure chamber as shown in FIG. 4D.

(Condition for Formation of Parallel Laminar Flows)

First, a condition for formation of liquids into laminar flows inside a tube will be described. The Reynolds number Re, which indicates the ratio of viscosity and interfacial tension, has been known as a general index for flow evaluation.

Here, let a liquid's density, flow speed, characteristic length, and viscosity be p, u, d, and respectively. Then, the Reynolds number Re can be expressed by Formula 1.

$$Re=\rho ud/\eta \quad \text{(Formula 1)}$$

Here, it is known that the smaller the Reynolds number Re is, the easier a laminar flow is formed. Specifically, it is known that a flow inside a circular tube is laminar in a case where the Reynolds number Re is, e.g., as small as about 2200, and the flow inside the circular tube is turbulent in a case where the Reynolds number Re is larger than about 2200.

In the case where the flow is laminar, it means the flow line is parallel to and does not cross the direction of advance of the flow. Then, in a case where two contacting liquids are both laminar, it is possible to form parallel flows with a stably formed interface between the two liquids.

Here, in the case of a general inkjet print head, a channel height (the height of the pressure chamber) H [μm] of each liquid channel (pressure chamber) around the ejection orifice is about 10 to 100 μm. Then, in a case where water (density $\rho=1.0\times103$ kg/m$^3$, viscosity $\eta=1.0$ cP) is caused to flow through the liquid channel of the inkjet print head at a flow speed of 100 mm/s, the Reynolds number is $Re=\rho ud/\eta\approx0.1$ to $1.0<<2200$. Hence, a laminar flow can be assumed to be formed.

Note that the liquid channel 13 and the pressure chamber 18 in the present embodiment may have a rectangular cross section, as illustrated in FIGS. 4A to 4D. Even in this case, since the height and width of the liquid channel 13 and the pressure chamber 18 in the liquid ejection head are sufficiently small, the liquid channel 13 and the pressure chamber 18 can be considered equivalent to a circular tube, that is, the height of the liquid channel 13 and the pressure chamber 18 can be considered as the diameter of a circular tube.

(Logical Conditions for Formation of Parallel Laminar Flows)

Next, conditions for formation of parallel flows of the two kinds of liquids with a stable interface therebetween inside the liquid channel 13 and the pressure chamber 18 will be described with reference to FIG. 4D. First, let the distance from the silicon substrate 15 to the ejection orifice surface of the orifice plate 14 be H [μm], and let the distance from the ejection orifice surface to the interface between the first liquid 31 and the second liquid 32 (the layer thickness of the second liquid) be $h_2$ [μm]. Also, let the distance from the interface to the silicon substrate 15 (the layer thickness of the first liquid) be $h_1$ [pm]. In other words, $H=h_1+h_2$.

Here, a boundary condition inside the liquid channel 13 and the pressure chamber 18 is assumed under which the speeds of the liquids at the wall surface of the liquid channel 13 and the pressure chamber 18 are zero. It is also assumed that the speed and shear stress of the interface between the first liquid 31 and the second liquid 32 are continuous. If, under these assumptions, the first liquid 31 and the second liquid 32 form two layers of constant parallel flows, the quadratic equation described in Formula 2 holds inside the parallel flow zone.

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)+h_1+\eta_1^2Q_1H^4=0 \quad \text{(Formula 2)}$$

Note that in Formula 2, $r_1$ denotes the viscosity of the first liquid, $\eta_2$ denotes the viscosity of the second liquid, $Q_1$ denotes the flow rate of the first liquid, and $Q_2$ denotes the flow rate of the second liquid. Specifically, the first liquid and the second liquid flow to form a positional relationship corresponding to their respective flow rates and viscosities within the range in which the above quadratic equation in Formula 2 is satisfied. As a result, parallel flows with a stable interface are formed. In the present embodiment, it is preferable that these parallel flows of the first liquid and the second liquid be formed at least in the pressure chamber 18 in the liquid channel 13. In a case where such parallel flows are formed, the first liquid and the second liquid are mixed only at the interface by molecular diffusion, and flow parallel to each other in the y direction without being substantially mixed with each other.

For example, even in a case of using immiscible solvents such as water and oil as the first liquid and the second liquid, stable parallel flows will be formed regardless of whether the liquids are immiscible as long as Formula 2 is satisfied. Also, in the case of water and oil too, it is preferable at least that the first liquid mainly flows over the pressure generation element and the second liquid mainly flows in the ejection orifice, as mentioned earlier, even if the flows inside the pressure chamber are somewhat disturbed and thus the interface is disturbed.

Figure 5A:
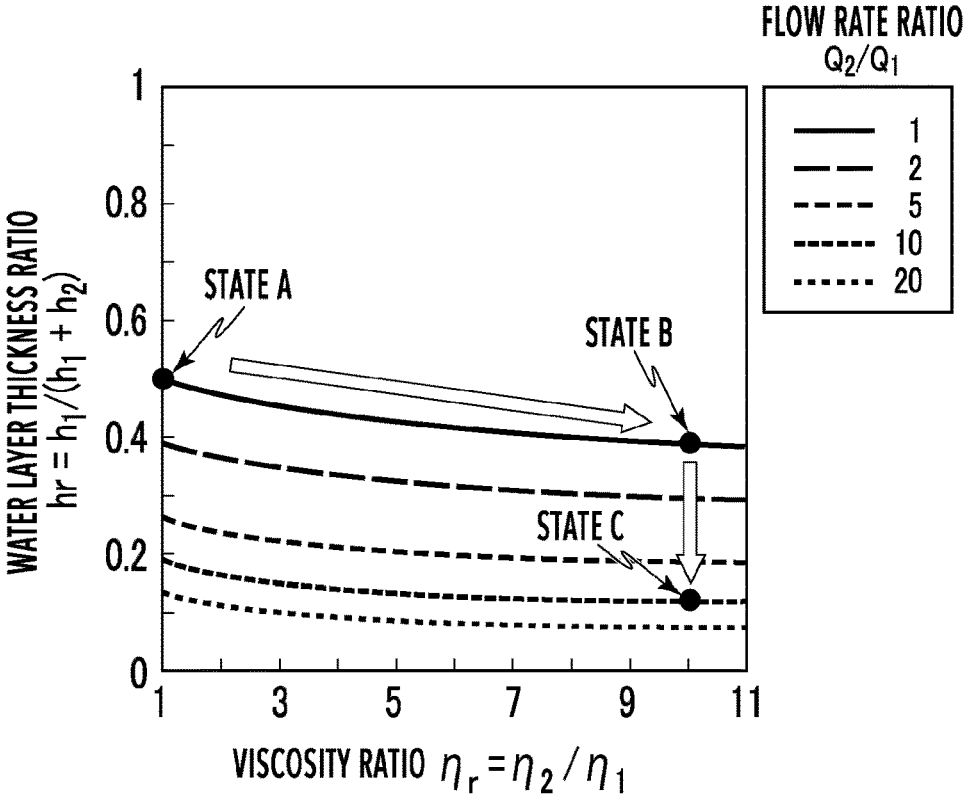
FIGS. 5A and 5B are diagrams showing the relationship between a viscosity ratio and a water layer thickness ratio, and the relationship between the height in the pressure chamber and the flow speed.

FIG. 5A is a diagram showing the relationship between a viscosity ratio $\eta_r=\eta_2/\eta_1$ and the first liquid's layer thickness ratio $h_r=h_1/(h_1+h_2)$ with a flow rate ratio $Q_r=Q_2/Q_1$ varied stepwise based on Formula 2. Note that although the first liquid is not limited to water, "the layer thickness ratio of the first liquid" will be hereinafter referred to as "water layer thickness ratio". The horizontal axis represents the viscosity ratio $\eta_r=\eta_2/\eta_1$ whereas the vertical axis represents the water layer thickness ratio $h_r=h_1/(h_1+h_2)$. The larger the flow rate ratio $Q_r$, the smaller the water layer thickness ratio $h_r$. Also, for each flow rate ratio $Q_r$, the larger the viscosity ratio $\eta_r$, the smaller the water layer thickness ratio $h_r$. Specifically, the water layer thickness ratio $h_r$ (the position of the interface between the first liquid and the second liquid) in the liquid channel 13 (pressure chamber) can be adjusted to a predetermined value by controlling the viscosity ratio $\eta_r$ and the flow rate ratio $Q_r$ of the first liquid and the second liquid. Then, according to the diagram, a comparison between the viscosity ratio $h_r$ and the flow rate ratio $Q_r$ indicates that the flow rate ratio $Q_r$ affects the water layer thickness ratio $h_r$ to a greater extent than the viscosity ratio $\eta_r$ does.

Here, a state A, a state B, and a state C shown in FIG. 5A represent the following states.

State A) The water layer thickness ratio $h_r=0.50$ with the viscosity ratio $\eta_r=1$ and the flow rate ratio $Q_r=1$.

State B) The water layer thickness ratio $h_r=0.39$ with the viscosity ratio $\eta_r=10$ and the flow rate ratio $Q_r=1$.

State C) The water layer thickness ratio $h_r=0.12$ with the viscosity ratio $\eta_r=10$ and the flow rate ratio $Q_r=10$.

Figure 5B:
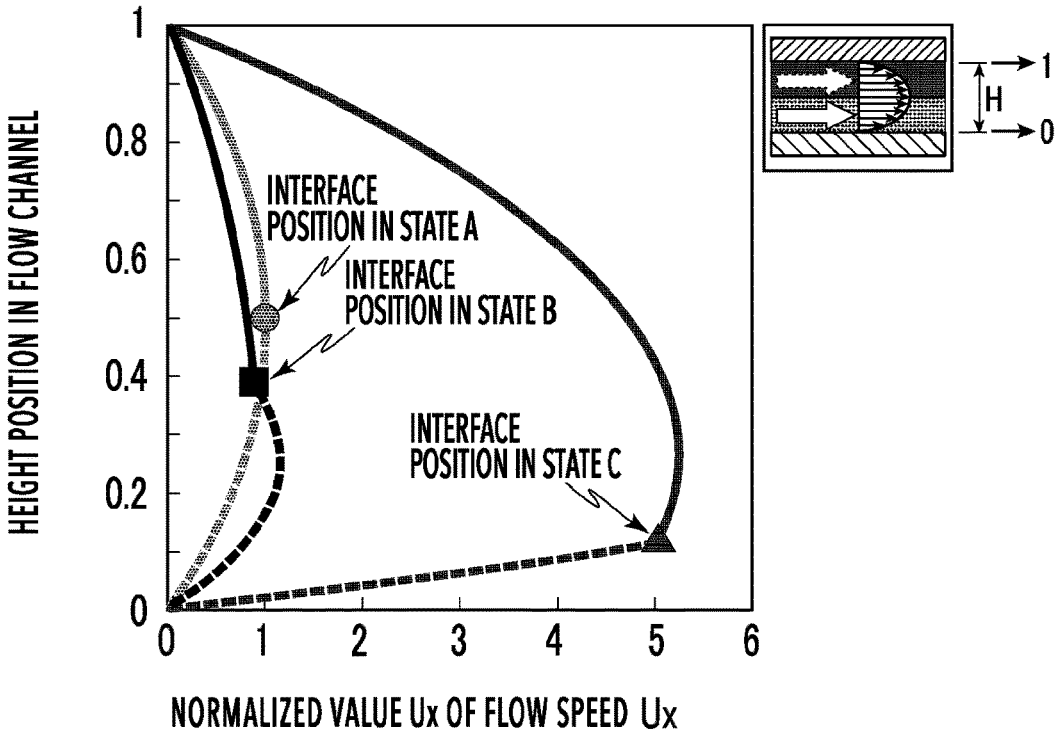

FIG. 5B is a diagram showing the distribution of flow speed in the liquid channel 13 (pressure chamber) in its height direction (z direction) for each of the above states A, B, and C. The horizontal axis represents a normalized value Ux normalized with the maximum value of the flow speed in the state A being 1 (reference). The vertical axis represents the height from the bottom surface with the height H of the liquid channel 13 (pressure chamber) being 1 (reference). On each of the curves indicating the above states, the position of the interface between the first liquid and the second liquid is indicated by a marker. It can be seen that the interface position varies from one state to another, like the interface position in the state A is higher than the interface positions in the state B and the state C. This is because, in a case where two kinds of liquids having different viscosities flow in parallel to each other as laminar flows (as a laminar flow as a whole) inside a tube, the interface between these two liquids is formed at the position at which the pressure difference originating from the viscosity difference between these liquids and the Laplace pressure originating from the interfacial tension balance each other.

(State of Transition in Ejection Operation)

Next, a description will be given of a state of transition in an ejection operation inside the liquid channel 13 and the pressure chamber 18 in which parallel flows are formed. FIGS. 6A to 6E are diagrams schematically showing a state of transition in an ejection operation performed in a state where parallel flows are formed with a first liquid and a second liquid having a viscosity ratio of $\eta_r=4$ inside a liquid channel 13 with a channel (pressure chamber) height of H [pm]=20 pm and an orifice plate thickness of T=6 μm.

Figures 6A, 6B, 6C, 6D, 6E:
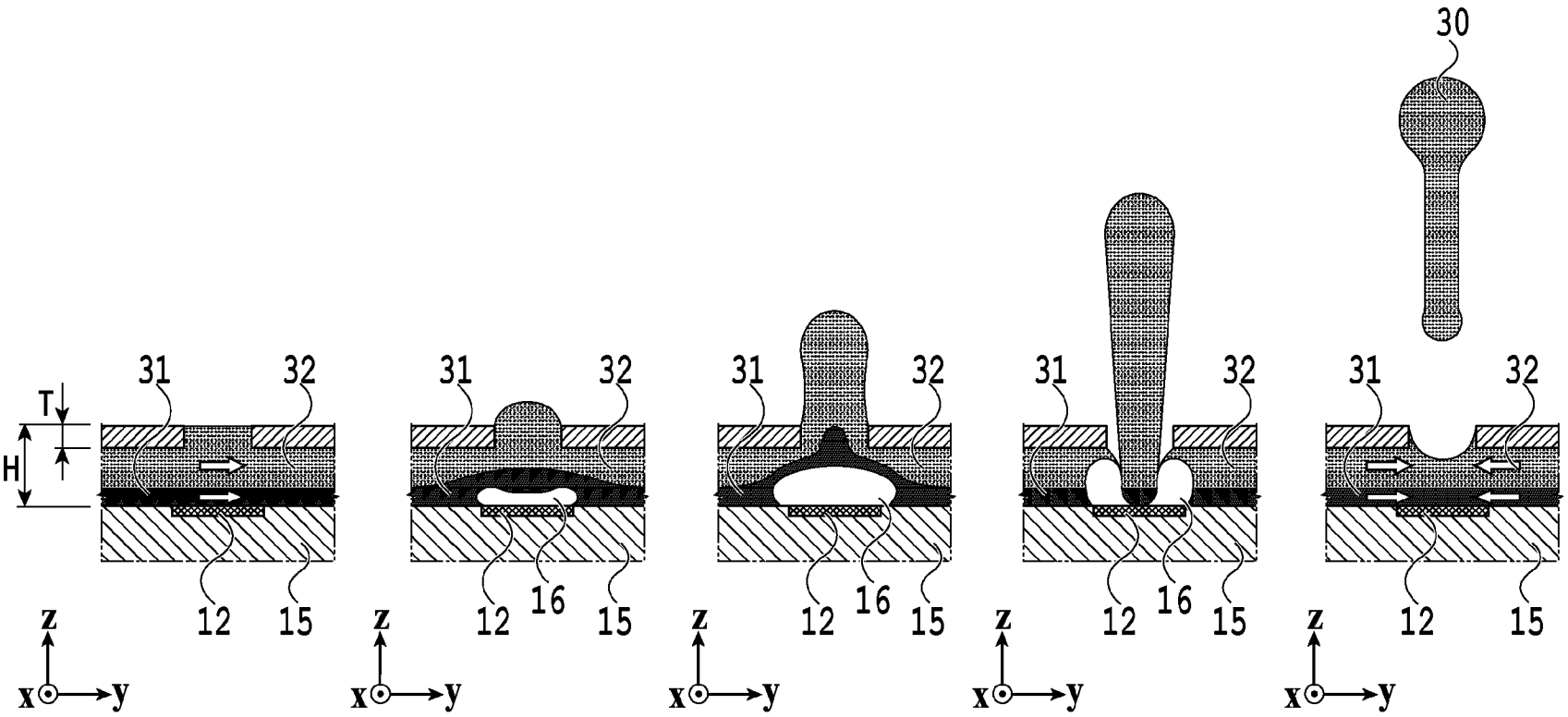
FIGS. 6A to 6E are diagrams schematically showing a state of transition in an ejection operation.

FIG. 6A shows a state before a voltage is applied to the pressure generation element 12. This diagram shows a state where $Q_1$ and $Q_2$ of the first and second liquids, which flow together, are adjusted such that the interface position is stable at the position at which the water layer thickness ratio $\eta_r=0.57$ (i.e., the first liquid's water thickness $h_1$ [μm]=6 μm).

FIG. 6B shows a state where the voltage starts to be applied to the pressure generation element 12. The pressure generation element 12 in the present embodiment is an electrothermal converter (heater). Specifically, in a case where a voltage pulse corresponding to an ejection signal is applied, the pressure generation element 12 abruptly generates heat, thereby causing film boiling inside the first liquid contacting the pressure generation element 12. The diagram shows a state where a bubble 19 is generated by the film boiling. By the generation of the bubble 19, the interface between the first liquid 31 and the second liquid 32 is moved accordingly in the z direction (the height direction of the pressure chamber), so that the second liquid 32 is pushed out from the ejection orifice 11 in the z direction.

FIG. 6C shows a state where the volume of the bubble 16 generated by the film boiling has increased, thereby pushing the second liquid 32 further out from the ejection orifice 11 in the z direction.

FIG. 6D shows a state where the bubble 16 is communicating with the atmosphere. In the present embodiment, at a contraction stage after the bubble 16 has fully grown, the bubble 16 and the gas-liquid interface having moved from the ejection orifice 11 to the pressure generation element 12 side communicate with each other.

FIG. 6E shows a state where a droplet 30 has been ejected. The liquid which had already projected from the ejection orifice 11 at the time when the bubble 19 communicated with the atmosphere as shown in FIG. 6D now exits the liquid channel 13 with its own inertia and flies in the form of the droplet 30 in the z direction. In the liquid channel 13, on the other hand, the amount of the liquid consumed by the ejection is supplied from both sides of the ejection orifice 11 by capillary force in the liquid channel 13, so that a meniscus is formed in the ejection orifice 11 again. Thereafter, parallel flows of the first liquid and the second liquid flowing in the y direction as illustrated in FIG. 6A are formed again.

As described above, in the present embodiment, the ejection operation shown in FIGS. 6A to 6E is performed with the first liquid 31 and the second liquid 32 flowing as parallel flows. To specifically describe this with reference to FIG. 2 again, the CPU 500 uses the liquid circulation unit 504 to circulate the first liquid and the second liquid inside the ejection head 1 while maintaining the flow rate of the first liquid and the flow rate of the second liquid constant. Then, while continuing such control, the CPU 500 applies a voltage to each individual pressure generation element 12 disposed in the ejection head 1 in accordance with ejection data. Note that there are also cases where the flow rate of the first liquid and the flow rate of the second liquid are not always constant depending on the amount of liquid to be ejected.

Note that performing an ejection operation with the liquids flowing entails a concern that the flow of the liquids may affect the ejection performance. However, the droplet ejection speed of a general inkjet print head is on the order of several m/s to several tens m/s and is significantly greater than the speed of the flow inside the liquid channel, which is on the order of several mm/s to several m/s. Thus, even in the case where an ejection operation is performed with the first liquid and the second liquid flowing at several mm/s to several m/s, it is unlikely to affect the ejection performance.

Although FIGS. 6A to 6E illustrate a configuration in which the bubble 19 and the atmosphere communicate with each other inside the pressure chamber 18, the configuration may be such that, for example, the bubble 19 communicates with the atmosphere outside the ejection orifice 11 (atmosphere side) or disappears without communicating with the atmosphere. An ejection operation as explained in FIGS. 6A to 6E can be performed with the liquids caused to flow or with the liquids temporarily stopped.

Performing an ejection operation with the liquids flowing, for example, entails a concern that the flow of the liquids may affect the ejection performance. However, the droplet ejection speed of a general inkjet print head is on the order of several m/s to several tens m/s and is significantly greater than the speed of the flow inside the liquid channel (pressure chamber), which is on the order of several mm/s to several m/s. Thus, even in the case where an ejection operation is performed with the first liquid 31 and the second liquid 32 flowing at several mm/s to several m/s, it is unlikely to affect the ejection performance.

On the other hand, performing an ejection operation with the liquids stopped entails a concern that the ejection operation may change the position of the interface between the first liquid 31 and the second liquid 32. However, stopping the flow of the liquids does not immediately affect the diffusion at the interface between the first liquid 31 and the second liquid 32. Even in the case where the flow is stopped, the interface between the first liquid 31 and the second liquid 32 is maintained and the ejection operation can be performed in this state as long as the time of the stop is as short as the time taken to perform an ejection operation.

In either case, the ejection operation can be stably performed regardless of whether the first liquid 31 and the second liquid 32 are flowing or not, as long as the interface between the liquids is held at a stable position.

(Advantage of Liquid Channel Structure in the Present Embodiment)

Now, an advantage of the structure of the liquid channel 13 in the present embodiment will be described with reference to FIGS. 4A to 4D again via a comparison with a comparative example shown in FIGS. 15A to 15C. The comparative example will be described first.

Figure 15A:
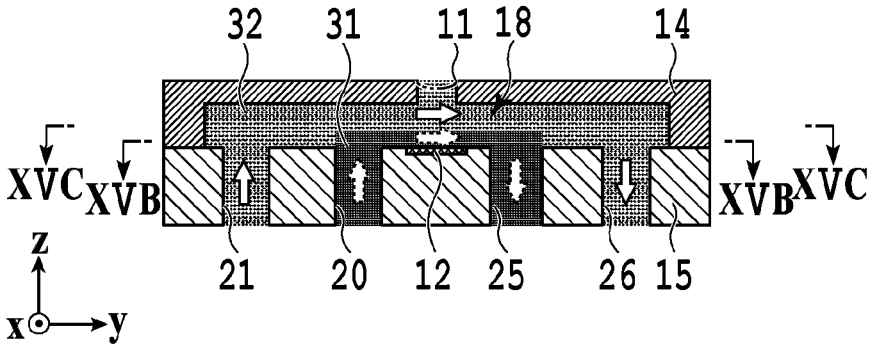
FIGS. 15A to 15C are diagrams for explaining a configuration of a fluid channel and a pressure chamber in a comparative example.
Figure 15B:
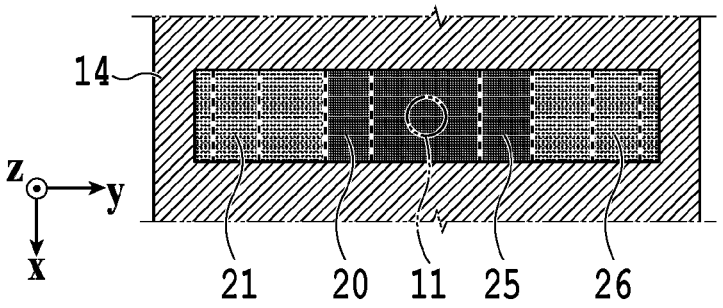
Figure 15C:
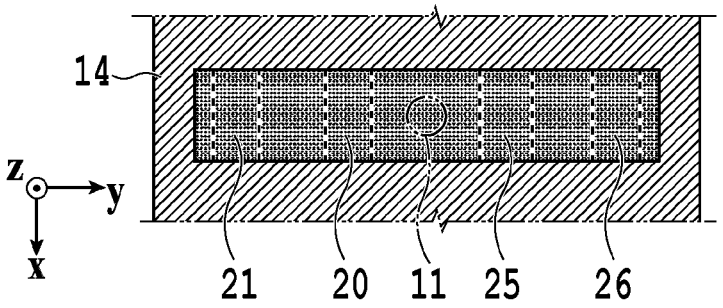

In the comparative example, FIG. 15A is a side cross-sectional view of one liquid channel 13 and FIGS. 15B and 15C are transparent cross-sectional views taken along the two cross-sectional lines shown in FIG. 15A. In a portion of the silicon substrate 15 corresponding to the bottom of the liquid channel 13, a second inlet port 21, a first inlet port 20, a first outlet port 25, and a second outlet port 26 having substantially the same width as that of the liquid channel 13 are formed in this order on a single line extending in the y direction.

Generally, in a configuration in which a silicon substrate includes a plurality of inlet ports having substantially the same width as that of a liquid channel and disposed in the direction of extension of the liquid channel, a liquid caused to flow in from the most downstream inlet port flows in contact with the silicon substrate. Specifically, in the comparative example shown in FIGS. 15A to 15C, the first liquid 31 caused to flow in from the first inlet port 20, which is disposed on the downstream side, flows in contact with the silicon substrate 15 whereas the second liquid 32 caused to flow in from the second inlet port 21, which is disposed on the upstream side, flows in contact with the orifice plate 14. In other words, in the liquid channel 13 shown in FIGS. 15A to 15C, the first liquid 31, which should be caused to flow in contact with the pressure generation element 12, needs to be caused to flow in from an inlet port downstream of the second liquid 32.

On the other hand, the second liquid 32, which is the ejection medium, generally has a higher viscosity than that of the first liquid. Also, the second liquid 32, which is the ejection medium, is required to be such that the amount of the liquid consumed by an ejection operation is recovered in a short time. In such circumstances, the flow resistance of the second liquid 32 with the higher viscosity is required to be lower than the flow resistance of the first liquid 31 with the lower viscosity. To satisfy this, it is preferable that the length of flow of the second liquid 32 from the position at which the second liquid 32 flows into the liquid channel 13 to the ejection orifice 11 be shorter than the length of flow of the first liquid 31 from the position at which the first liquid 31 flows into the liquid channel 13 to the ejection orifice 11.

Here, the channel configuration of the present embodiment shown in FIGS. 4A to 4D and the configuration of the comparative example shown in FIGS. 15A to 15C are compared. In the comparative example, the length of flow from the second inlet port 21 to the ejection orifice 11 is longer than the length of flow from the first inlet port 20 to the ejection orifice 11. On the other hand, in the channel configuration of the present embodiment shown in FIGS. 4A to 4D, the length of flow from the second inlet port 21 to the ejection orifice 11 is shorter than the length of flow from the first inlet port 20 to the ejection orifice 11 since the first structural member 17 is provided. In other words, the flow resistance of the second liquid 32 with the higher viscosity is lower than that in the comparative example. Thus, with the channel configuration of the present embodiment, the amount of the second liquid 32 consumed by an ejection operation is recoverable in a shorter time than that in the comparative example. This makes it possible to perform a fine ejection operation at a high frequency.

Second Embodiment

Figure 7A:
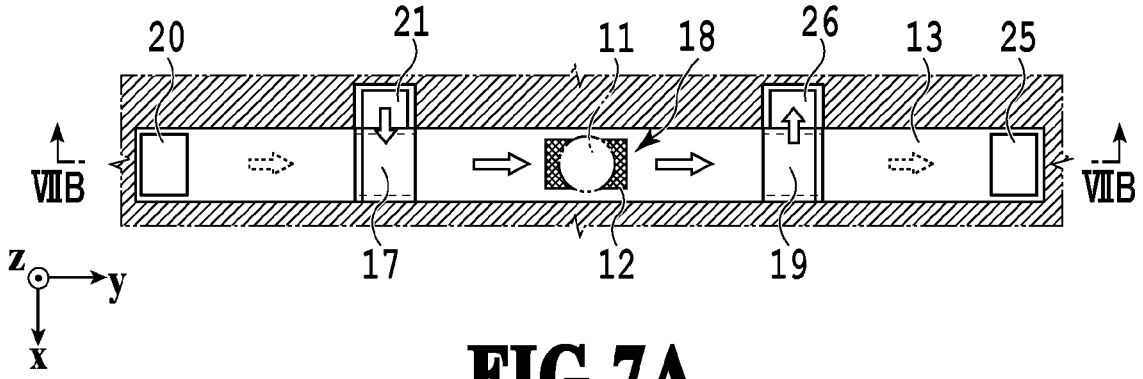
FIGS. 7A to 7C are diagrams for explaining a configuration of a liquid channel and a pressure chamber in a second embodiment.
Figure 7B:
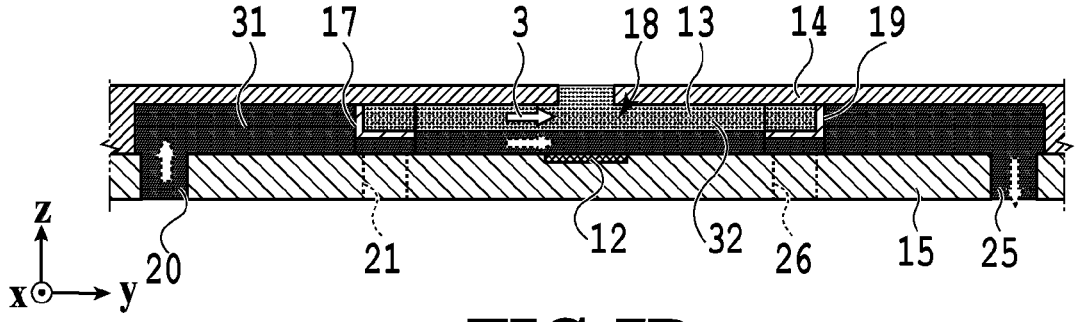
Figure 7C:
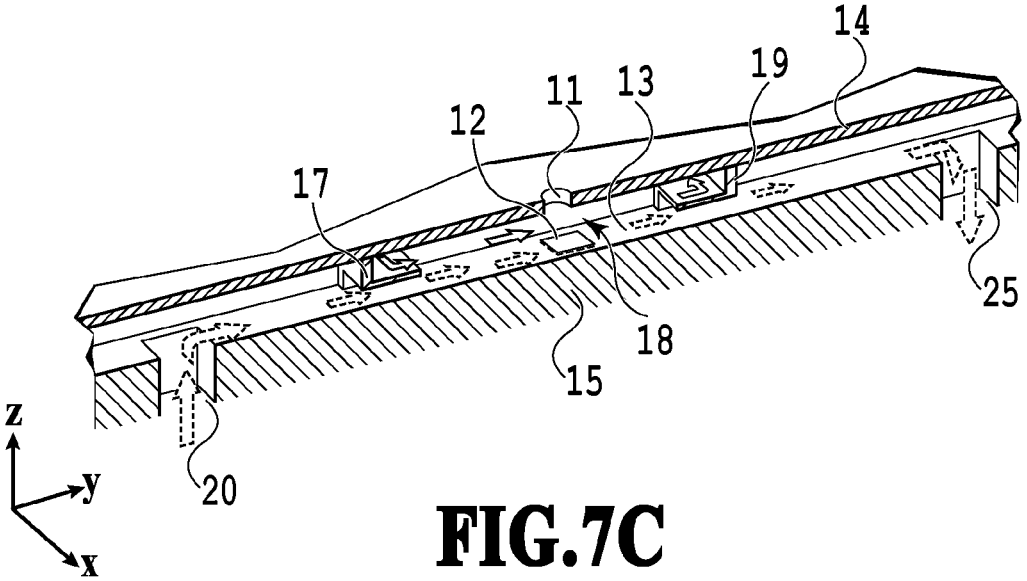

FIGS. 7A to 7C are diagrams showing a structure of a liquid channel 13 in a second embodiment. FIG. 7A is a transparent view from an ejection orifice 11 side (+z direction side), and FIG. 7B is a cross-sectional view taken along VIIB-VIIB line shown in FIG. 7A. Also, FIG. 7C is a perspective cross-sectional view of the element substrate 10.

The present embodiment differs from the first embodiment in that, in addition to the second inlet port 21, the second outlet port 26 is disposed at a position offset from the liquid channel 13 in the −x direction. The present embodiment differs from the first embodiment also in that a second structural member 19 is provided which separates the first liquid 31 and the second liquid 32 having passed the pressure chamber 18 from each other. The flow direction of the second liquid 32 having passed the pressure chamber 18 and advancing in the +y direction is changed to the −x direction by the upper channel over the second structural member 19, and the second liquid 32 is caused to flow out from the second outlet port 26. On the other hand, the first liquid 31 having passed the pressure chamber 18 advances in the +y direction through the lower channel under the second structural member 19 and is caused to flow out from the first outlet port 25.

According to the present embodiment as described above, the length of flow of the second liquid 32 in the liquid channel 13 is shorter than that in the first embodiment. In other words, the flow resistance of the second liquid 32 with the higher viscosity is lower than that in the first embodiment. This makes it possible to perform a fine ejection operation at a higher frequency.

Third Embodiment

Figure 8A:
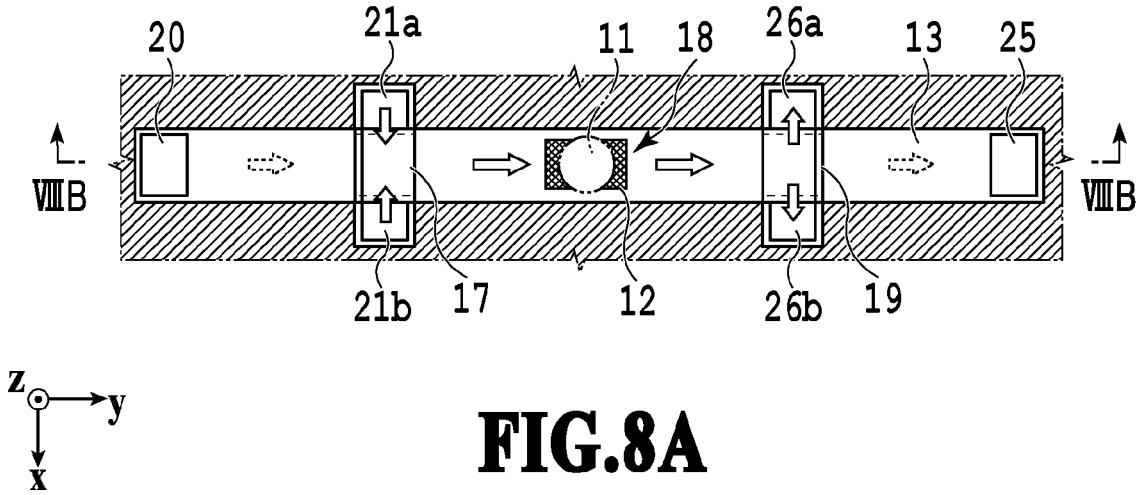
FIGS. 8A and 8B are diagrams for explaining a configuration of a liquid channel and a pressure chamber in a third embodiment.
Figure 8B:
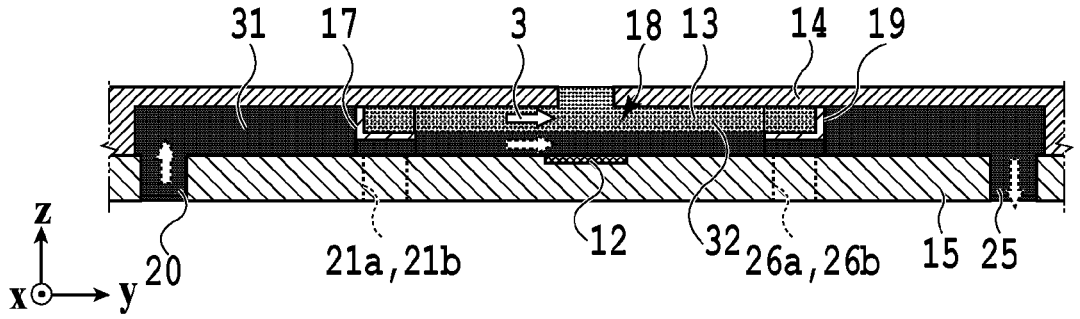

FIGS. 8A and 8B are diagrams showing a structure of a liquid channel 13 in a third embodiment. FIG. 8A is a transparent view from an ejection orifice 11 side (+z direction side), and FIG. 8B is a cross-sectional view taken along line shown in FIG. 8A.

The present embodiment differs from the second embodiment in that the second inlet port 21 and the second outlet port 26 are disposed on either side of the liquid channel 13 in the ±x direction. The flow direction of the second liquid 32 caused to flow in from two second inlet ports 21*a* and 21*b* is changed to the +y direction by the upper channel over a first structural member 17. On the other hand, the first liquid 31 caused to flow into the liquid channel 13 from the first inlet port 20 flows through the lower channel under the first structural member 17. The first liquid 31 and the second liquid 32 flow in the +y direction respectively through the upper channel and the lower channel over and under the first structural member 17, contact each other at the downstream end of the first structural member 17, thereby forming an interface therebetween, and reach the pressure chamber 18 in the form of parallel flows.

The flow direction of the second liquid 32 having passed the pressure chamber 18 and flowing in the +y direction is changed to the +x direction or the −x direction by the upper channel over a second structural member 19, and the second liquid 32 is caused to flow out from a second outlet port 26*a* or 26*b*. On the other hand, the first liquid 31 having passed the pressure chamber 18 advances in the +y direction through the lower channel under the second structural member 19 and is caused to flow out from the first outlet port 25.

According to the present embodiment as described above, the second liquid 32 with the higher viscosity is caused to flow into and out of the liquid channel 13 through the two inlet ports 21*a* and 21*b* and the two outlet ports 26*a* and 26*b*. Thus, the amount of the second liquid 32 consumed by an ejection operation is recoverable in a shorter time than those in the first and second embodiments. This makes it possible to perform a fine ejection operation at a high frequency.

Fourth Embodiment

Figure 9A:
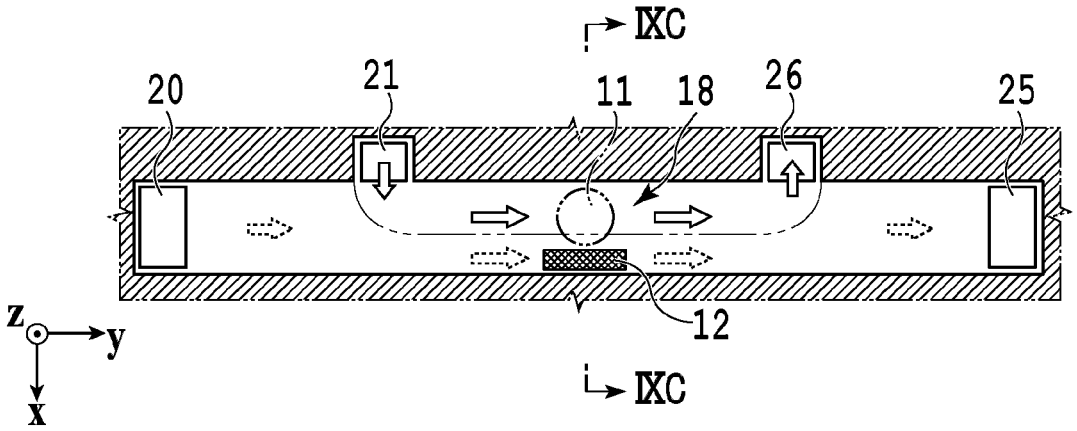
FIGS. 9A to 9C are diagrams for explaining a configuration of a liquid channel and a pressure chamber in a fourth embodiment.
Figure 9B:
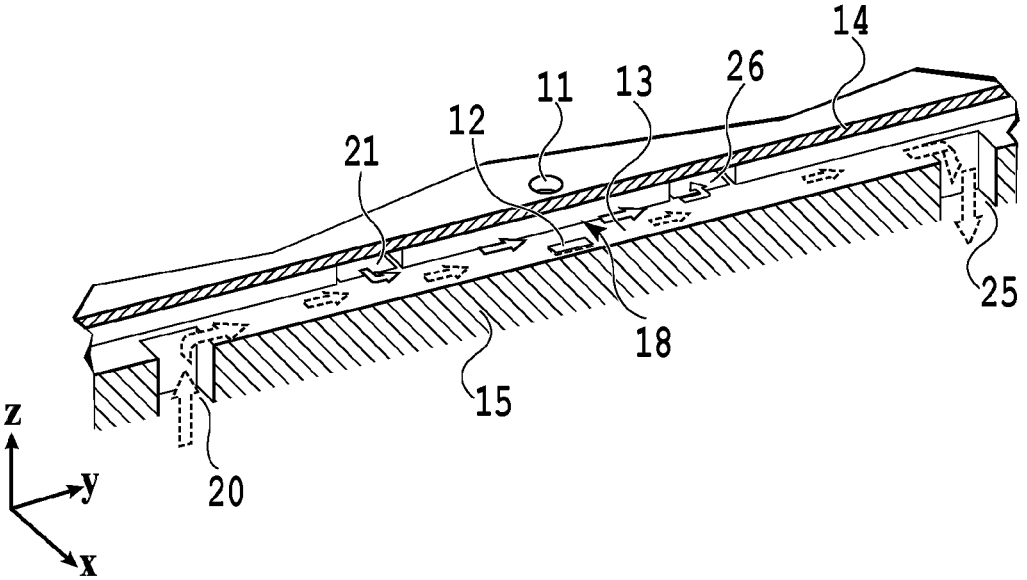
Figure 9C:
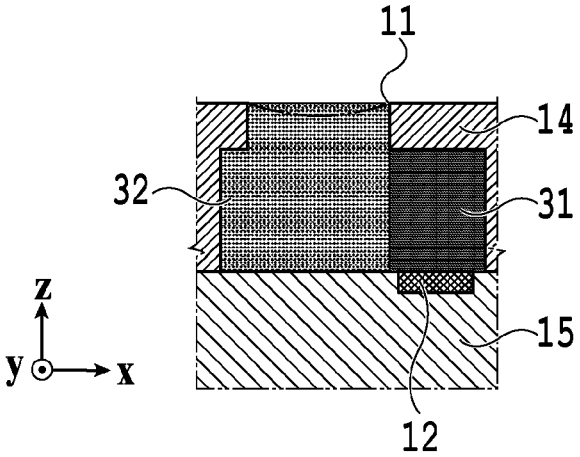

FIGS. 9A to 9C are diagrams showing a structure of a liquid channel 13 in a fourth embodiment. FIG. 9A is a transparent view from an ejection orifice 11 side (+z direction side), FIG. 9B is a perspective cross-sectional view of the element substrate 10, and FIG. 9C is an enlarged cross-sectional view taken along IXC-IXC line in FIG. 9A.

In a portion of a silicon substrate 15 corresponding to the bottom of the liquid channel 13, a first inlet port 20, a second inlet port 21, a second outlet port 26, and a first outlet port 25 are formed in this order in the +y direction. Among the first inlet port 20, the second inlet port 21, a pressure chamber 18, the second outlet port 26, and the first outlet port 25, the second inlet port 21 and the second outlet port 26 are disposed at positions offset in the −x direction from a single line extending in the y direction. The pressure chamber 18, which contains the ejection orifice 11 and a pressure generation element 12, is disposed substantially at the midpoint between the second inlet port 21 and the second outlet port 26 in the y direction.

In such a configuration, a first liquid 31 supplied into the liquid channel 13 from the first inlet port 20 flows in the y direction (indicated by the broken-line arrows), passes the pressure chamber 18, and then flows out from the first outlet port 25. On the other hand, a second liquid 32 supplied into the liquid channel 13 through the second inlet port 21 from the −x direction side collides with the first liquid 31, thereby changing the direction of its flow, and flows in the +y direction (indicated by the solid-line arrow). In the present embodiment, structural members as described in the above embodiments are not provided. Thus, the first liquid 31 and the second liquid 32 do not form layers superimposed on one another in the up-down direction (±z direction) but form layers lying next to each other in the left-right direction (±x direction) as shown in FIG. 9B. Then, after the first liquid 31 and the second liquid 32 pass the pressure chamber 18 in the form of parallel flows lying next to each other in the left-right direction as described above, the second liquid 32 changes the direction of its flow to the −x direction and is caused to flow out from the second outlet port 26.

In the present embodiment, the pressure generation element 12 and the ejection orifice 11 are disposed to be offset from each other in the x direction. Moreover, mainly the first liquid 31 flows on the pressure generation element 12 side (+x side) and mainly the second liquid 32 flows on the ejection orifice 11 side (−x side). By applying a voltage to the pressure generation element 12, a bubble is generated by film boiling inside the first liquid 31 in contact with the pressure generation element 12, and the second liquid pressurized through the interface is ejected from the ejection orifice 11.

In the present embodiment as described above too, in the liquid channel 13, the length of flow of the second liquid 32 with the higher viscosity is shorter than the length of flow of the first liquid 31 with the lower viscosity. In other words, the flow resistance of the second liquid 32 with the higher viscosity is low. Accordingly, the amount of the second liquid 32 consumed by an ejection operation is recoverable in a short time. This makes it possible to perform a fine ejection operation at a high frequency.

(Effect of Gravity)

Here, the effect of gravity on an interface will be briefly described. Assuming, for example, that the +z direction in drawings is a direction against gravity, the interface between the parallel flows formed in the first to third embodiments is a surface perpendicular to gravity, whereas the interface between the parallel flows formed in the present embodiment is a surface parallel to gravity. Specifically, the condition for forming a stable interface in the present embodiment is expected to be different from that in the foregoing embodiments. However, the effect of gravity on the interface can be said to be extremely small due to the reason to be described below.

Generally, a Bond number Bo, which is a dimensionless number representing the ratio of gravity and surface tension (interfacial tension), is defined by the following formula.

$$Bo=(\Delta\rho g L^2)/\gamma$$

Here, $\Delta\rho$ denotes the density difference, g denotes the gravitational acceleration, L denotes the characteristic length, and $\gamma$ denotes the surface tension. In a case where the density difference $\Delta\rho=0.04$ g/cm$^3$ and the surface tension $\gamma=30$ mN/m, the interfacial tension is at least 10000 times greater than gravity with a characteristic length of L=10 to 100 In other words, the effect of gravity on an interface is extremely small regardless of the orientation of the interface. For this reason, in the present embodiment, it is possible to form parallel flows lying next to each other in the left-right direction (±x direction) with a stable interface therebetween by adjusting the flow rates of the first liquid and the second liquid so as to satisfy Formula 2 described in the first embodiment.

Fifth Embodiment

Figure 10A:
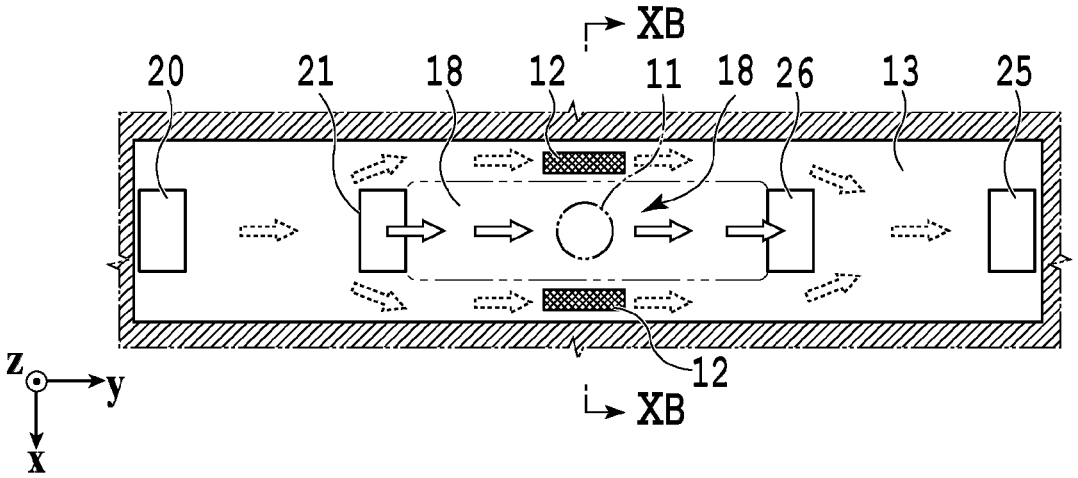
FIGS. 10A and 10B are diagrams for explaining a configuration of a liquid channel and a pressure chamber in a fifth embodiment.
Figure 10B:
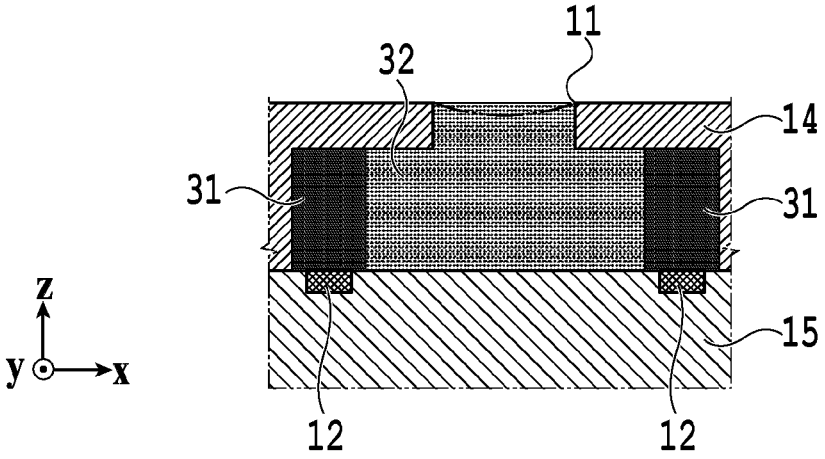

FIGS. 10A and 10B are diagrams showing a structure of a liquid channel 13 in a fifth embodiment. FIG. 10A is a transparent view from an ejection orifice 11 side (+z direction side), and FIG. 10B is an enlarged cross-sectional view taken along XB-XB line in FIG. 10A.

In a portion of a silicon substrate 15 corresponding to the bottom of the liquid channel 13, a first inlet port 20, a second inlet port 21, a second outlet port 26, and a first outlet port 25 are formed in this order in the +y direction. A pressure chamber 18, which contains the ejection orifice 11 and pressure generation elements 12, is disposed substantially at the midpoint between the second inlet port 21 and the second outlet port 26 in the y direction. In the first to fourth embodiments, the liquid channel 13 has substantially the same width (size in the x direction) as those of the inlet and outlet ports arrayed on a single line extending in they direction. The liquid channel 13 in the present embodiment, on the other hand, has a larger width than those of the inlet and outlet ports, which are arrayed on a single line.

As shown in FIG. 10A, a first liquid 31 having flowed in from the first inlet port 20 flows along the broken-line arrows and is caused to flow out from the first outlet port 25. A second liquid 32 having flowed in from the second inlet port 21 moves along the solid-line arrows and is caused to flow out from the second outlet port 26. In the region between the second inlet port 21 and the second outlet port 26 in the y direction, the first liquid 31 and the second liquid 32 flow together, but the first liquid 31 flows between the second liquid 32 and channel walls so as to bypass the flow path of the second liquid 32. Then, in the pressure chamber 18, in which the ejection orifice 11 and the pressure generation elements 12 are disposed, parallel flows of the first liquid 31, the second liquid 32, and the first liquid 31 lying side by side in this order in the x direction are formed, as shown in FIG. 10B.

As shown in FIGS. 10A and 10B, the pressure generation elements 12 are disposed at positions on the opposite sides on the silicon substrate 15 where the first liquid 31 flows, respectively. On the other hand, in the portion of the orifice plate 14 at the position where the second liquid 32 flows, the ejection orifice 11 is formed, and the second liquid 32 exposed to the atmosphere forms a meniscus. By simultaneously driving the two pressure generation elements 12 in this state, bubbles are generated by film boiling inside the first liquid 31 in contact with the pressure generation elements 12, and the second liquid pressurized through the interfaces on the opposite sides is ejected from the ejection orifice 11. In the present embodiment, the pressure generation elements 12 are symmetrically disposed with respect to the ejection orifice 11. This enables an ejection droplet 30 to be ejected in a symmetrical shape in the x direction.

In the present embodiment as described above too, in the liquid channel 13, the length of flow of the second liquid 32 with the higher viscosity is shorter than the length of flow of the first liquid 31 with the lower viscosity. In other words, the flow resistance of the second liquid 32 with the higher viscosity is low. Accordingly, the amount of the second liquid 32 consumed by an ejection operation is recoverable in a short time. This makes it possible to perform a fine ejection operation at a high frequency.

Sixth Embodiment

Figure 11C:
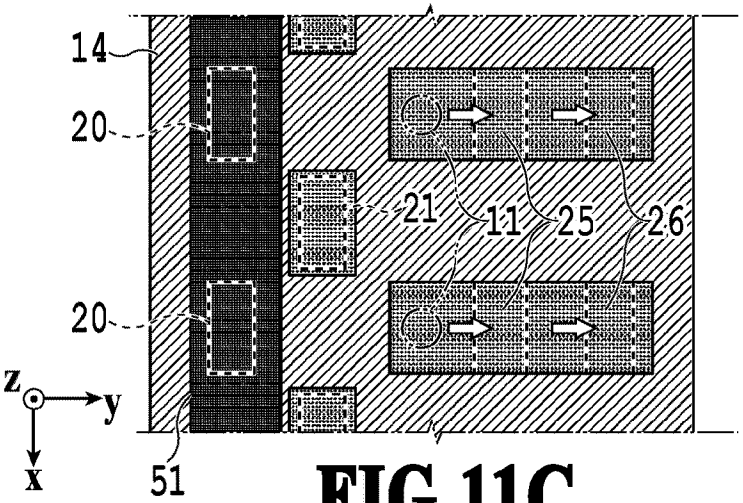
FIGS. 11A to 11D are diagrams for explaining a configuration of liquid channels and pressure chambers in a sixth embodiment.
Figure 11D:
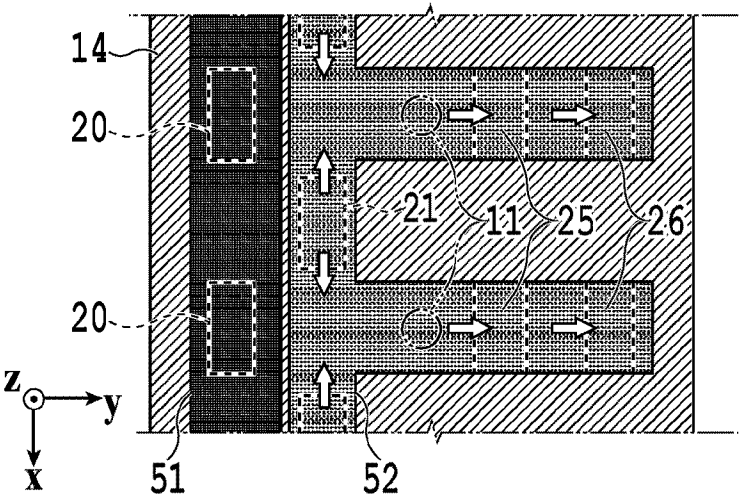
Figure 11A:
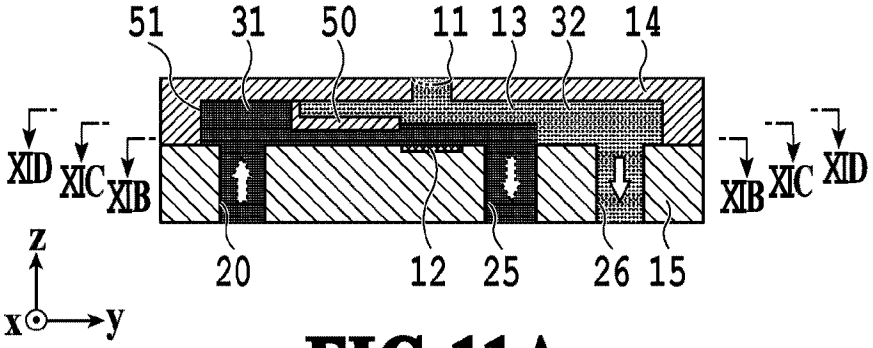
Figure 11B:
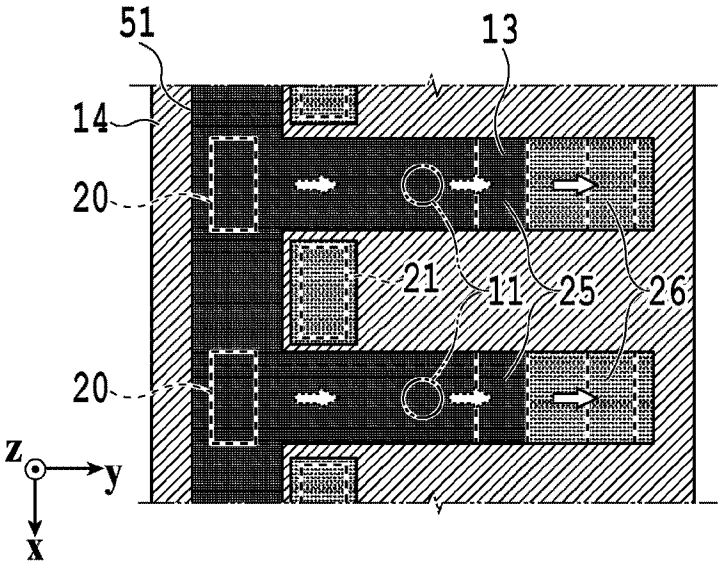

FIGS. 11A to 11D are diagrams showing a structure of liquid channels 13 in a sixth embodiment. FIG. 11A is a side cross-sectional view of one liquid channel 13. FIG. 11B is a transparent cross-sectional view taken along XIB-XIB line shown in FIG. 11A, FIG. 11C is a transparent cross-sectional view taken along XIC-XIC line shown in FIG. 11A, and FIG. 11D is a transparent cross-sectional view taken along XID-XID line shown in FIG. 11A.

In the present embodiment, a first inlet port 20, a first outlet port 25, and a second outlet port 26 are disposed on a single line extending in the y direction. Among these, the first outlet port 25 and the second outlet port 26 are provided in a one-to-one correspondence for each pressure chamber 18, and the first inlet port 20 is connected to a first common liquid chamber 51 extending in the x direction and communicating with a plurality of liquid channels 13. A first liquid 31 having flowed into the first common liquid chamber 51 from the first inlet port 20 flows in the y direction through a channel on the −z direction side of a structural member 50 (lower channel) and reaches the pressure chamber 18.

A second inlet port 21, on the other hand, is disposed between two liquid channels 13 adjacent to each other in the x direction and is connected to a second common liquid chamber 52 communicating with the plurality of liquid channels 13. A second liquid 32 having flowed into the second common liquid chamber 52 from the second inlet port 21 splits toward the opposite sides in the ±x direction and advances through a channel on the +z direction side of the structural member 50 (upper channel). Further, the direction of the flow is changed to the +y direction, and then the second liquid 32 reaches the pressure chamber 18.

In the present embodiment, the direction of flow of the first liquid 31 in the lower channel under the structural member 50 (+y direction) and the direction of flow of the second liquid 32 in the upper channel over the structural member 50 (±x direction) cross each other. However, the direction of advance of the second liquid 32 is changed to the y direction at the upper channel over the structural member 50. Thus, at the end of the structural member 50 on the +y direction side, the first liquid 31 and the second liquid 32 advance together in the +y direction and merge, thereby forming an interface therebetween, and reach the pressure chamber 18 in the form of parallel flows.

Inside the pressure chamber 18, a pressure generation element 12 is in contact with the first liquid 31, and the second liquid 32 at the ejection orifice 11 exposed to the atmosphere forms a meniscus. By applying a voltage to the pressure generation element 12, a bubble is generated by film boiling inside the first liquid 31 in contact with the pressure generation element 12, and the second liquid pressurized through the interface is ejected from the ejection orifice 11 in the +z direction. Among the liquids that have not been ejected from the ejection orifice 11 and have passed the pressure chamber 18, the first liquid 31 is caused to flow out from the first outlet port 25, and the second liquid 32 is caused to flow out from the second outlet port 26.

In the present embodiment described above too, the length of flow from the second inlet port 21 to the ejection orifice 11 is shorter than the length of flow from the first inlet port 20 to the ejection orifice 11. In other words, the flow resistance of the second liquid 32 with the higher viscosity is low. This makes it possible to perform a fine ejection operation at a high frequency.

Seventh Embodiment

Figure 12A:
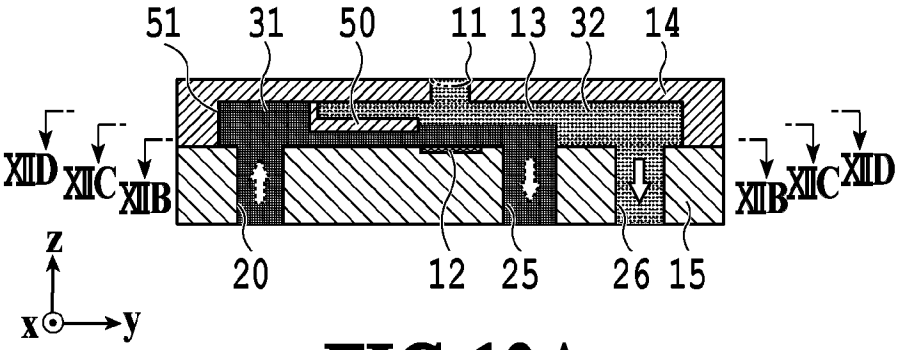
FIGS. 12A to 12D are diagrams for explaining a configuration of liquid channels and pressure chambers in a seventh embodiment.
Figure 12B:
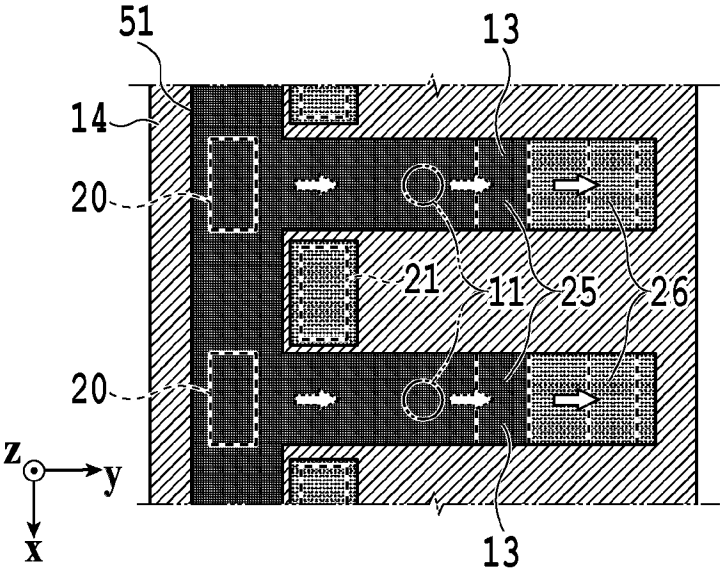
Figure 12C:
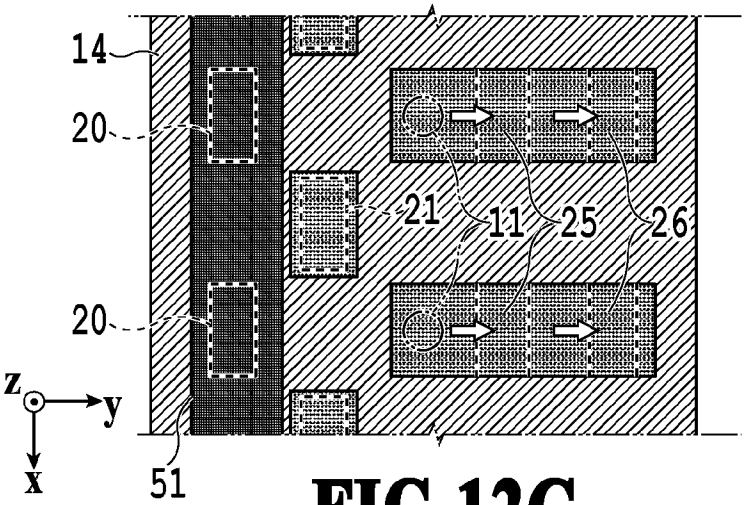
Figure 12D:
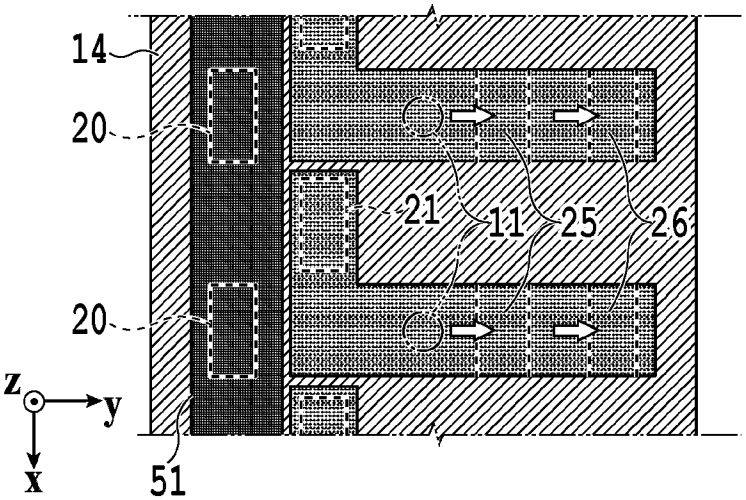

FIGS. 12A to 12D are diagrams showing a structure of liquid channels 13 in a seventh embodiment. FIG. 12A is a side cross-sectional view of one liquid channel 13. FIG. 12B is a transparent cross-sectional view taken along XIIB-XIIB line shown in FIG. 12A, FIG. 12C is a transparent cross-sectional view taken along XIIC-XIIC line shown in FIG. 12A, and FIG. 12D is a transparent cross-sectional view taken along XIID-XIID line shown in FIG. 12A.

The liquid channel 13 in the present embodiment differs from the liquid channel 13 described in the sixth embodiment in that the second common liquid chamber 52 is not provided. Specifically, the second inlet ports 21 and the pressure chambers 18 are provided in a one-to-one correspondence. The direction of advance of the second liquid 32 having flowed in from each second inlet port 21 is changed from the +x direction to the +y direction by the upper channel over a corresponding structural member 50. Then, at the end of the structural member 50 on the +y direction side, the first liquid 31 and the second liquid 32 advance together in the +y direction and merge, thereby forming an interface therebetween, and reach the pressure chamber 18 in the form of parallel flows.

In the present embodiment described above too, the length of flow from the second inlet port 21 to the ejection orifice 11 is shorter than the length of flow from the first inlet port 20 to the ejection orifice 11. In other words, the flow resistance of the second liquid 32 with the higher viscosity is low. This makes it possible to perform a fine ejection operation at a high frequency.

Eighth Embodiment

Figure 13A:
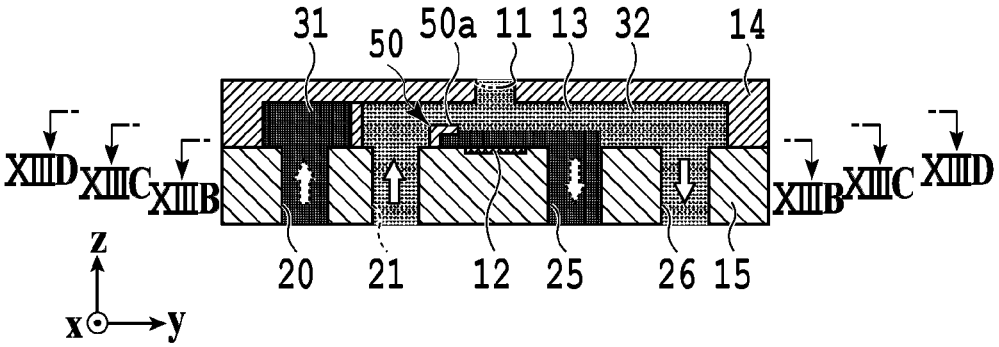
FIGS. 13A to 13D are diagrams for explaining a configuration of a liquid channel and a pressure chamber in an eighth embodiment.
Figure 13B:
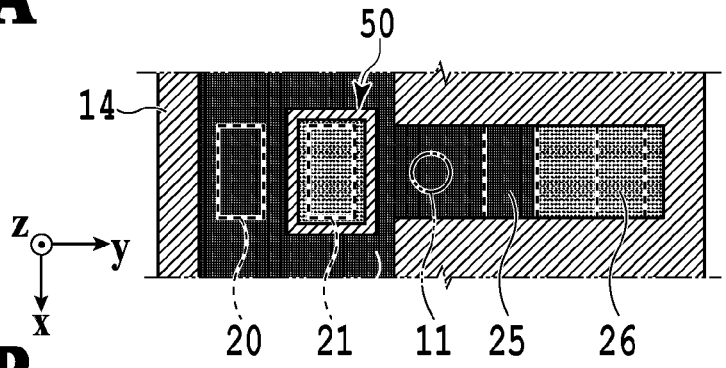
Figure 13C:
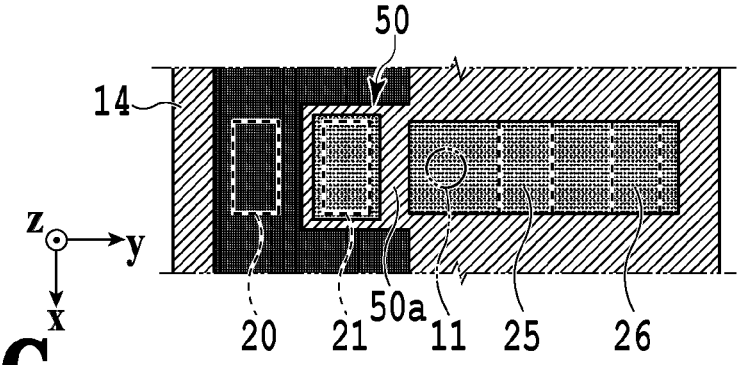
Figure 13D:
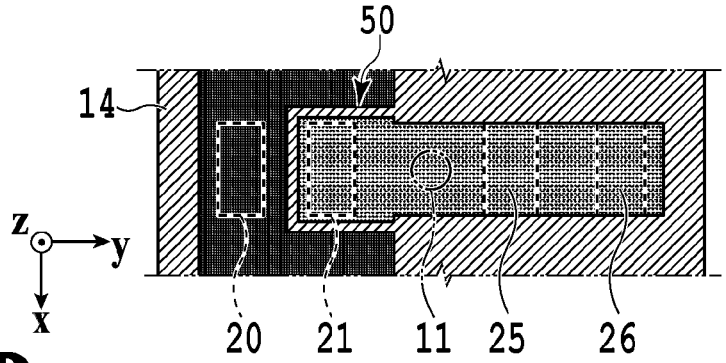

FIGS. 13A to 13D are diagrams showing a structure of a liquid channel 13 in an eighth embodiment. FIG. 13A is a side cross-sectional view of one liquid channel 13. FIG. 13B is a transparent cross-sectional view taken along line shown in FIG. 13A, FIG. 13C is a transparent cross-sectional view taken along XIIIC-XIIIC line shown in FIG. 13A, and FIG. 13D is a transparent cross-sectional view taken along XIIID-XIIID line shown in FIG. 13A.

In the present embodiment, a first inlet port 20, a second inlet port 21, a first outlet port 25, and a second outlet port 26 are provided for each pressure chamber 18 in a one-to-one correspondence, and disposed on a single line extending in the y direction. A first liquid 31 having flowed in from the first inlet port 20 advances in the y direction but is blocked by a structural member 50 and moves so as to bypass the structural member 50, i.e., the flow path of a second liquid 32.

On the other hand, the direction of advance of the second liquid 32 having flowed in from the second inlet port 21 is changed from the +z direction to the +y direction by the structural member 50 and the orifice plate 14. Then, the second liquid 32 flows along an upper channel over a merge wall 50*a* being a part of the structural member 50. Thereafter, the first liquid 31 flowing under the merge wall 50*a* and the second liquid 32 flowing over the merge wall 50*a* advance together in the +y direction and merge at the end of the merge wall 50*a*, thereby forming an interface therebetween, and reach the pressure chamber 18 in the form of parallel flows.

In the present embodiment described above too, the length of flow from the second inlet port 21 to the ejection orifice 11 is shorter than the length of flow from the first inlet port 20 to the ejection orifice 11. In other words, the flow resistance of the second liquid 32 with the higher viscosity is low. This makes it possible to perform a fine ejection operation at a high frequency.

Ninth Embodiment

Figure 14A:
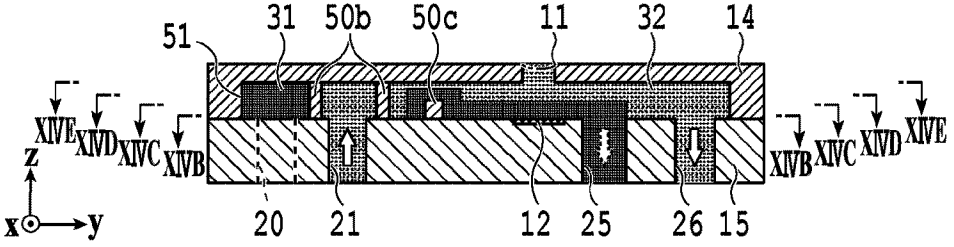
FIGS. 14A to 14E are diagrams for explaining a configuration of liquid channels and pressure chambers in a ninth embodiment.
Figure 14B:
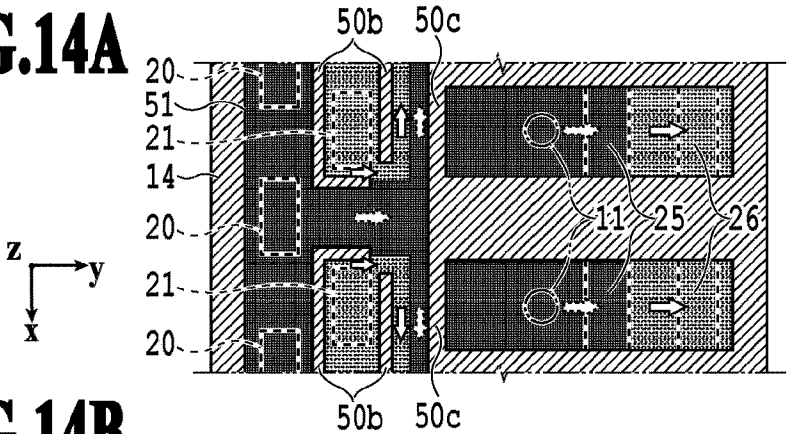
Figure 14C:
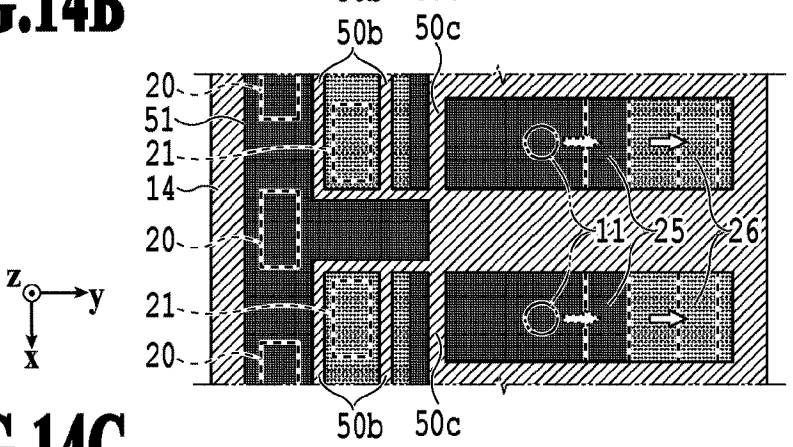
Figure 14D:
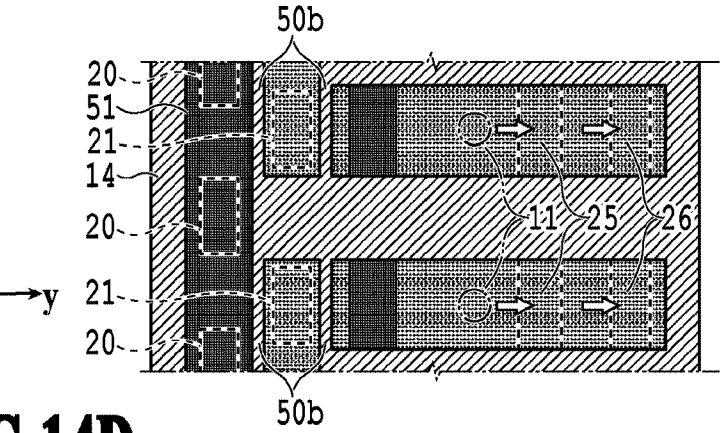
Figure 14E:
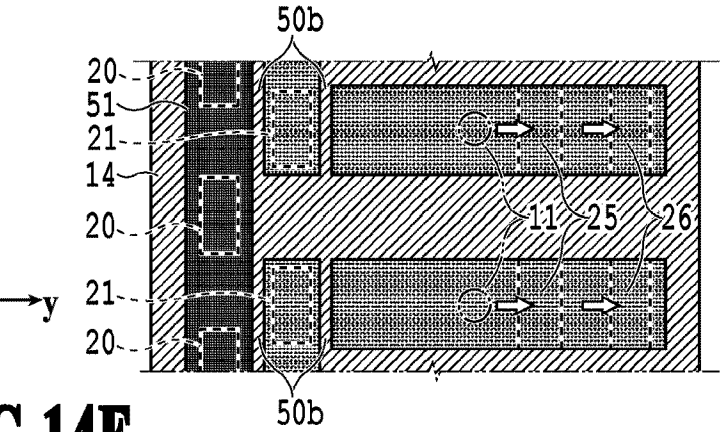

FIGS. 14A to 14E are diagrams showing a structure of liquid channels 13 in a ninth embodiment. FIG. 14A is a side cross-sectional view of one liquid channel 13. FIG. 14B is a transparent cross-sectional view taken along XIVB-XIVB line shown in FIG. 14A, and FIG. 14C is a transparent cross-sectional view taken along XIVC-XIVC line shown in FIG. 14A. FIG. 14D is a transparent cross-sectional view taken along XIVD-XIVD line shown in FIG. 14A, and FIG. 14E is a transparent cross-sectional view taken along XIVE-XIVE line shown in FIG. 14A.

In the liquid channel 13 in the present embodiment, a second inlet port 21, a first outlet port 25, and a second outlet port 26 are disposed on a single line extending in the y direction and provided for each pressure chamber 18 in a one-to-one correspondence. A first inlet port 20 is disposed between two liquid channels 13 adjacent to each other in the x direction and is connected to a first common liquid chamber 51 extending in the x direction and communicating with a plurality of liquid channels 13. A first liquid 31 having flowed into the first common liquid chamber 51 from the first inlet port 20 advances in the y direction between two columnar structural members 50*b* each being a part of a structural member 50.

On the other hand, a second liquid 32 having flowed in from the second inlet port 21 advances in the +z direction through the space inside the corresponding columnar structural member 50*b*. Then, the second liquid 32 flows out in the +y direction from a gap at the bottom of the columnar structural member 50*b* and merges with the first liquid 31 flowing likewise in the +y direction, thereby forming an interface therebetween. As a result, two layers of parallel flows lying next to each other in the x direction are formed (see FIG. 14B). Such parallel flows then collide with a protruding structural member 50*c*, thereby changing the direction of advance to the +x direction or the −x direction and entering the gap between the columnar structural member 50*b* and the protruding structural member 50*c*. Then, the parallel flows collide with the orifice plate 14 so as to become parallel flows in which the layer of the first liquid 31 and the layer of the second liquid 32 lie next to each other in the z direction, and reach the pressure chamber 18 in that state (see FIG. 14A).

In the present embodiment described above too, the length of flow from the second inlet port 21 to the ejection orifice 11 is shorter than the length of flow from the first inlet port 20 to the ejection orifice 11. In other words, the flow resistance of the second liquid 32 with the higher viscosity is low. This makes it possible to perform a fine ejection operation at a high frequency.

(Methods of Manufacturing Liquid Channel)

Methods of manufacturing a liquid channel 13 will be described below with reference to drawings by taking two examples.

(First Manufacturing Method)

Figure 16A:
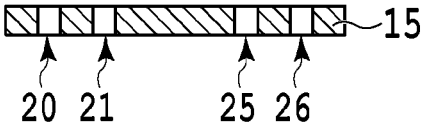
FIGS. 16A to 16J are diagrams explaining an example process of manufacturing a liquid channel.
Figure 16B:
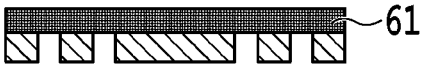

FIGS. 16A to 16J are diagrams explaining an example process of manufacturing a liquid channel 13. These diagrams show an example process of manufacturing the liquid channel 13 in the first embodiment shown in FIGS. 4A to 4D. First, a φ200-mm silicon substrate 15 is prepared, and a heat generating resistive element and wirings (not shown) that will serve as the pressure generation element 12 are formed. Then, through-holes that will serve as the first inlet port 20, the second inlet port 21, the first outlet port 25, and the second outlet port 26 are formed in the silicon substrate 15 (FIG. 16A).

Figure 16C:
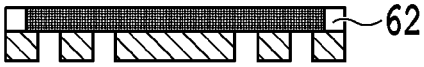

Then, a 5 μm-thick first negative resist 61 formed as a dry film is laminated on the silicon substrate 15 (FIG. 16B), and a channel is patterned therein by an exposure process. As a result, an exposed first negative resist 62 is obtained (FIG. 16C). Examples of the first negative resist include SU-8 3000 manufactured by Nippon Kayaku Co., Ltd.

Figure 16D:
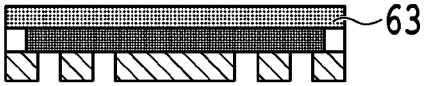
Figure 16E:
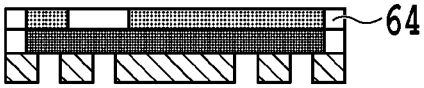

Then, a 5 μm-thick second negative resist 63 having a higher sensitivity than that of the first negative resist 61 and formed as a dry film is laminated on the exposed first negative resist 62 (FIG. 16D). Moreover, an exposure process for forming a channel pattern including the first structural member 17 (see FIGS. 4A to 4D) is performed. As a result, an exposed second negative resist 64 is obtained (FIG. 16E).

Figure 16F:
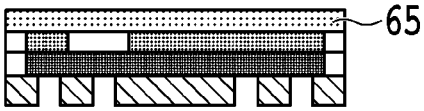
Figure 16G:
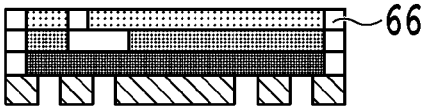

Then, a 5 μm-thick third negative resist 65 having a higher sensitivity than that of the second negative resist 63 and formed as a dry film is laminated on the exposed second negative resist 64 (FIG. 16F). Moreover, an exposure process for forming a channel pattern including the first structural member 17 (see FIGS. 4A to 4D) is performed. As a result, an exposed third negative resist 66 is obtained (FIG. 16G).

Figure 16H:
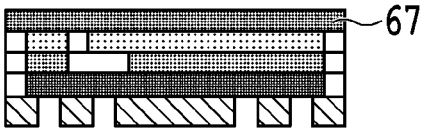
Figure 16I:
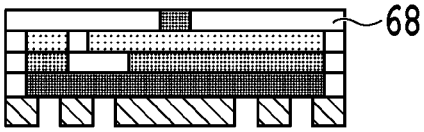

Further, a 5 μm-thick fourth negative resist 67 having a higher sensitivity than that of the third negative resist 65 and formed as a dry film is laminated on the exposed third negative resist 66 (FIG. 16H). Then, an exposure process for forming the ejection orifice 11 (see FIGS. 4A to 4D) is performed. As a result, an exposed fourth negative resist 68 is obtained (FIG. 16I).

Figure 16J:
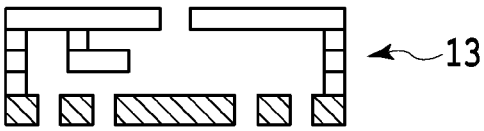

Lastly, a process of collectively developing the exposed first to fourth negative resists 62, 64, 66, and 68 is performed. As a result, the liquid channel structure in the first embodiment as shown in FIG. 16J is completed.

(Second Manufacturing Method)

FIGS. 17A to 17J are diagrams explaining another example process of manufacturing a liquid channel 13. These diagrams also show a process of manufacturing the liquid channel 13 in the first embodiment shown in FIGS. 4A to 4D.

Figure 17A:
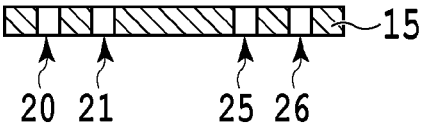
FIGS. 17A to 17J are diagrams explaining an example process of manufacturing a liquid channel.

First, a φ200-mm silicon substrate 15 is prepared, and a heat generating resistive element and wirings (not shown) that will serve as the pressure generation element 12 are formed. Then, through-holes that will serve as the first inlet port 20, the second inlet port 21, the first outlet port 25, and the second outlet port 26 are formed in the silicon substrate 15 (FIG. 17A).

Figure 17B:
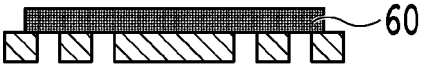
Figure 17C:
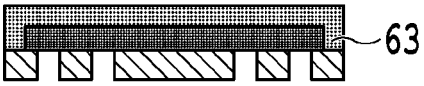

Then, a 5 μm-thick positive resist 60 formed as a dry film is laminated on the silicon substrate 15, and a channel pattern is patterned therein by an exposure process and a development process (FIG. 17B). Examples of the positive resist used include a positive resist ODUR-1010A manufactured by TOKYO OHKA KOGYO CO., LTD.

Figure 17D:
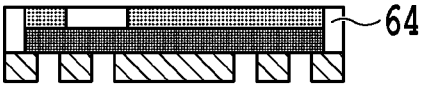

Then, a 5 μm-thick second negative resist 63 formed as a dry film is laminated on the positive resist 60 (FIG. 17C), and a channel pattern including the first structural member 17 (see FIGS. 4A to 4D) is patterned by an exposure process. As a result, an exposed second negative resist 64 is obtained (FIG. 17D). Examples of the second negative resist include SU-8 3000 manufactured by Nippon Kayaku Co., Ltd.

Figure 17E:
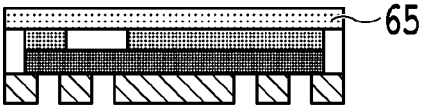
Figure 17F:
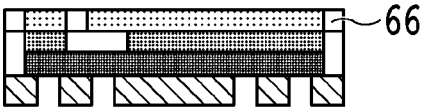

Then, a 5 μm-thick third negative resist 65 having a higher sensitivity than that of the second negative resist 63 and formed as a dry film is laminated on the exposed second negative resist 64 (FIG. 17E). Moreover, an exposure process for forming a channel pattern including the first structural member 17 (see FIGS. 4A to 4D) is performed. As a result, an exposed third negative resist 66 is obtained (FIG. 17F).

Figure 17G:
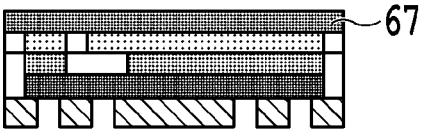
Figure 17H:
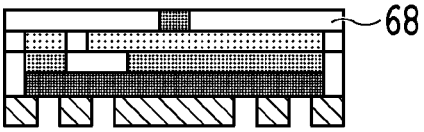

Further, a 5 μm-thick fourth negative resist 67 having a higher sensitivity than that of the third negative resist 65 and formed as a dry film is laminated on the exposed third negative resist 66 (FIG. 17G). Then, an exposure process for forming the ejection orifice 11 (see FIGS. 4A to 4D) is performed. As a result, an exposed fourth negative resist 68 is obtained (FIG. 17H).

Figure 17I:
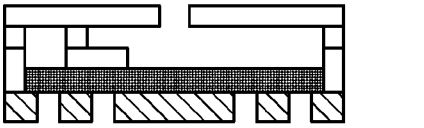
Figure 17J:
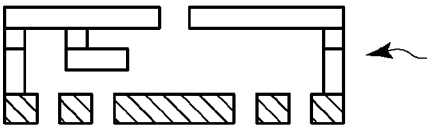

Then, a process of collectively developing the exposed second to fourth negative resists 64, 66, and 68 is performed. As a result, a structure as shown in FIG. 17I is obtained. Lastly, an exposure light is applied to the entire substrate surface to thereby remove the positive resist layer 60. As a result, the liquid channel structure in the first embodiment as shown in FIG. 17J is completed.

In the first manufacturing method shown in FIGS. 16A to 16J among the two manufacturing methods described above, after the steps of laminating four layers of negative resists, the four layers of negative resists are collectively developed to complete the liquid channel structure. In the second manufacturing method shown in FIGS. 17A to 17J, on the other hand, a step of laminating one layer of a positive resist and steps of laminating three layers of negative resists are performed, and the positive resist layer 60 is removed after the three layers of negative resists are collectively developed. In both methods, lamination and exposure of a negative resist layer are repeated a plurality of times, and the plurality of negative resist layers are collectively developed. Such methods can shorten the manufacturing time and are preferable for improving the flatness of the element substrate 10. Note that the plurality of negative resist layers do not necessarily have to be developed collectively. Each negative resist layer may be developed after the formation of that one layer of an exposed negative resist.

The sensitivities of the negative resist layers are preferably such that the sensitivity of the unexposed fourth negative resist 67 is the highest, followed by those of the unexposed third negative resist 65, the unexposed second negative resist 63, and the unexposed first negative resist 61 in this order, as mentioned above. In this way, the negative resists are laminated and exposed in ascending order of sensitivity. This creates an environment in which a resist with a higher sensitivity cures but a resist with a lower sensitivity does not cure, and thus enables desired patterning to be performed. Considering the above point, the second manufacturing method, which involves inserting one layer of a positive resist, is preferable for adjusting the sensitivity of each negative resist, although the step of removing the positive resist is added.

(Specific Example of First Liquid, Second Liquid, and Third Liquid)

The bubble generation medium (first liquid) and the ejection media (second liquid, third liquid) employable in the above embodiments will be specifically described below by taking specific examples.

The bubble generation medium (first liquid 31) in the above embodiments is required to be such that in a case where the electrothermal converter generates heat, film boiling occurs in the bubble generation medium and the generated bubble enlarges abruptly. In other words, the bubble generation medium is required to have such a high critical pressure that enables efficient conversion of thermal energy into bubble generation energy. Water is particularly preferable as such a medium. Water, although its molecular weight is as small as 18, has a high boiling point (100° C.), a high surface tension (58.85 dyne/cm at 100° C.), and a high critical pressure of approximately 22 MPa. In other words, the bubble generation pressure for film boiling is significantly high as well. Generally, inkjet printing apparatuses of the type that performs ink ejection by using film boiling preferably use ink made of water with a color material such as a dye or pigment contained therein.

The bubble generation medium, however, is not limited to water. A medium having a critical pressure of 2 MPa or higher (preferably 5 MPa or higher) can function as the bubble generation medium. Examples of the bubble generation medium other than water include methyl alcohol and ethyl alcohol, and a mixture of water and any of these liquids can be used as the bubble generation medium as well. Also, a medium made of water with a color material such as a dye or pigment, as mentioned above, or another additive contained therein can be used as well.

The ejection medium in the above embodiments (second liquid 32), on the other hand, is not required to have physical properties for causing film boiling like the bubble generation medium. Also, attachment of kogation to the top of the electrothermal converter (heater) leads to a concern that the smoothness of the heater surface may be impaired and/or the thermal conductivity may be lowered, thereby lowering the bubble generation efficiency. However, since the ejection medium does not directly contact the heater, the components contained therein are unlikely to get burnt. Specifically, the ejection medium has less strict physical property requirements for causing film boiling and avoiding kogation than those of conventional thermal head inks. This increases the degree of freedom in the components contained, and thus enables the ejection medium to actively contain components suitable for usage after ejection.

For example, a pigment that has not conventionally been used due to the reason that it gets easily burnt on a heater can be actively contained in the ejection medium in the above embodiments. Also, in the above embodiments, a liquid other than an aqueous ink with significantly low critical pressure can be used as the ejection medium. Further, any of various inks with special functions that have been difficult to use with conventional thermal heads, such as ultraviolet curable inks, electrically conductive inks, EB (electron beam) curable inks, magnetic inks, and solid inks, can be used as the ejection medium. Also, by using any of blood, cells in a culture liquid, and so on as the ejection medium, the liquid ejection heads in the above embodiments can be used in various applications other than image formation. The liquid ejection heads in the above embodiments can be effectively used in applications such as biochip fabrication and electronic circuit printing.

In particular, a configuration in which water or a liquid similar to water is the first liquid (bubble generation medium) while pigment inks with higher viscosities than that of water are the second liquid and the third liquid (ejection media), and only the second and third liquids are ejected is one effective application of the embodiments. In such a case too, it is effective to keep the water layer thickness ratio $h_r$ low by making the flow rate ratio $Q_r=Q_2/Q_1$ as low as possible, as shown in FIG. 5A. Note that since the liquids as the ejection media are not limited, the same liquid as any of the liquids listed as the first liquid can be used. For example, in a case where each of the above liquids is an ink containing a large amount of water, it is possible to use one of the inks as the first liquid and the other ink as the second liquid depending on a situation such as the mode of use, for example.

(Example in Which Ejected Droplet Contains Mixed Liquid)

Next, a description will be given of a case where the ejected droplet 30 is ejected in a state where the first liquid 31 and the second liquid 32 or the first liquid 31, the second liquid 32, and further a third liquid 33 are mixed in a predetermined ratio. In a case where, for example, the first liquid 31 and the second liquid 32 are inks of different colors, these inks will form laminar flows inside the liquid channel 13 and the pressure chamber 18 without their colors being mixed, if the Reynolds number calculated based on both liquids' viscosities and flow rates satisfies a relationship in which the Reynolds number is smaller than a predetermined value. Specifically, by controlling the flow rate ratio $Q_r$ of the first liquid 31 and the second liquid 32 in the liquid channel and the pressure chamber, it is possible to adjust the water layer thickness ratio $h_r$ and thus the mixture ratio of the first liquid 31 and the second liquid 32 in the ejected droplet 30 to a desired ratio.

For example, in a case where the first liquid is a clear ink and the second liquid is a cyan ink (or a magenta ink), it is possible to eject light cyan inks (or light magenta inks) with various color material densities by controlling the flow rate ratio $Q_r$. Also, in a case where the first liquid is a yellow ink and the second liquid is a magenta ink, it is possible to eject various types of red inks with hues varying in a stepwise manner by controlling the flow rate ratio $Q_r$. Specifically, if it is possible to eject a droplet in which the first liquid and the second liquid are mixed in a desired ratio, then the color reproduction range to be expressed on a print medium can be made wider than conventional ranges by adjusting the mixture ratio.

Also, the configurations of the present embodiments are effective in a case where two kinds of liquids are used which are preferably not mixed until immediately before ejection and mixed immediately after ejection. For example, in image printing, there are cases where a highly concentrated pigment ink having excellent color developability and a resin emulsion (resin EM) having excellent fastness such as excellent scratch resistance are preferred to be applied to a print medium at the same time. However, the pigment component contained in the pigment ink and the solid component contained in the resin EM are prone to aggregate in a case where the distance between particles is short. Thus, the dispersiveness tends to be impaired. Then, in a case where the first liquid is a highly concentrated resin emulsion (EM) while the second liquid is a highly concentrated pigment ink and the flow speeds of these liquids are controlled to form their parallel flows, the two liquids get mixed and aggregate on a print medium after being ejected. Specifically, it is possible to maintain a preferable ejection state with the high dispersiveness and obtain an image having high color developability and excellent fastness after landing.

Note that causing two liquids to flow in the pressure chamber is effective in a case as above where mixing after ejection is to be achieved, regardless of the form of the pressure generation element. Specifically, the above embodiments function effectively even with a configuration using a piezoelectric element as the pressure generation element, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-148516 filed Aug. 13, 2019, which is hereby incorporated by reference herein in its entirety.

What is claimed is:

1. A liquid ejection head comprising:

a liquid channel which is formed by laminating a substrate and a channel forming member and through which a first liquid and a second liquid are caused to flow in a predetermined direction;

a first inlet port through which the first liquid is caused to flow into the liquid channel;

a second inlet port through which the second liquid is caused to flow into the liquid channel;

a pressure generation element which is disposed in the substrate and pressurizes the first liquid; and an ejection orifice which is formed in the channel forming member and through which the second liquid is ejected in a direction crossing the predetermined direction by pressure received from the first liquid pressurized by the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

2. The liquid ejection head according to claim 1, wherein the second inlet port is provided at a position between the first inlet port and the ejection orifice in the predetermined direction.

3. The liquid ejection head according to claim 1, wherein in the liquid channel, a structural member is provided which causes the first liquid and the second liquid to flow without contacting each other and then causes the first liquid and the second liquid to contact each other and flow in the predetermined direction.

4. The liquid ejection head according to claim 3, wherein the structural member causes the first liquid and the second liquid caused to flow in from mutually crossing directions to flow in different directions without contacting each other and then causes the first liquid and the second liquid to contact each other and flow in the predetermined direction as parallel flows.

5. The liquid ejection head according to claim 3, wherein the structural member causes the first liquid to flow so as to bypass a flow path of the second liquid, and then causes the first liquid and the second liquid to contact each other and flow in the predetermined direction as parallel flows.

6. The liquid ejection head according to claim 3, wherein an interface between the first liquid and the second liquid is changed from a surface perpendicular to the substrate to a surface parallel to the substrate by the structural member.

7. The liquid ejection head according to claim 1, wherein an interface between the first liquid and the second liquid is a surface parallel to the substrate.

8. The liquid ejection head according to claim 1, further comprising:

a first outlet port through which the first liquid is caused to flow out of the liquid channel; and a second outlet port through which the second liquid is caused to flow out of the liquid channel, wherein the second outlet port is provided at a position between the ejection orifice and the first outlet port in the predetermined direction.

9. The liquid ejection head according to claim 8, wherein two second inlet ports and two second outlet ports are provided for the liquid channel.

10. The liquid ejection head according to claim 1, wherein in the channel forming member, a first common liquid chamber is provided to which a plurality of first inlet ports and a plurality of liquid channels are connected.

11. The liquid ejection head according to claim 10, wherein in the channel forming member, a second common liquid chamber is provided to which a plurality of second inlet ports and the plurality of the liquid channels are connected.

12. The liquid ejection head according to claim 1, further comprising:

a first outlet port through which the first liquid is caused to flow out of the liquid channel; and a second outlet port through which the second liquid is caused to flow out of the liquid channel, wherein the second inlet port is provided between the first inlet port and the ejection orifice in the predetermined direction, and the second outlet port is provided between the ejection orifice and the first outlet port in the predetermined direction, and an interface between the first liquid and the second liquid is a surface perpendicular to the substrate.

13. The liquid ejection head according to claim 12, wherein the second inlet port causes the second liquid to flow into the liquid channel in a direction crossing flow of the first liquid in the predetermined direction, and the second outlet port causes the second liquid to flow out of the liquid channel in a direction crossing the flow of the first liquid in the predetermined direction.

14. The liquid ejection head according to claim 12, wherein the first inlet port, the second inlet port, the ejection orifice, the second outlet port, and the first outlet port are provided in the listed order on a single line extending in the predetermined direction, the liquid channel has a longer width than widths of the first inlet port, the second inlet port, the first outlet port, and the second outlet port, the second liquid flows from the second inlet port to the second outlet port in the predetermined direction along the single line, and the first liquid flows in the predetermined direction on opposite sides of a flow path of the second liquid.

15. The liquid ejection head according to claim 1, wherein viscosity of the second liquid is higher than viscosity of the first liquid.

16. The liquid ejection head according to claim 1, wherein inside the liquid channel, a flow rate of the second liquid is higher than a flow rate of the first liquid.

17. The liquid ejection head according to claim 1, wherein the pressure generation element causes film boiling in the first liquid by generating heat in response to application of voltage to the pressure generation element.

18. A liquid ejection apparatus comprising:

a liquid ejection head including:

a liquid channel which is formed by laminating a substrate and a channel forming member and through which a first liquid and a second liquid are caused to flow in a predetermined direction, a first inlet port through which the first liquid is caused to flow into the liquid channel, a second inlet port through which the second liquid is caused to flow into the liquid channel, a pressure generation element which is disposed in the substrate and pressurizes the first liquid, and an ejection orifice which is formed in the channel forming member and through which the second liquid is ejected in a direction crossing the predetermined direction by pressure received from the first liquid pressurized by the pressure generation element;

a flow control unit which controls the flow of the first liquid and the second liquid in the liquid channel; and a drive unit which drives the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

19. A liquid ejection module that forms a liquid ejection head by being arrayed with one or more other liquid ejection modules, the liquid ejection module comprising:

a liquid channel which is formed by laminating a substrate and a channel forming member and through which a first liquid and a second liquid are caused to flow in a predetermined direction;

a first inlet port through which the first liquid is caused to flow into the liquid channel;

a second inlet port through which the second liquid is caused to flow into the liquid channel;

a pressure generation element which is disposed in the substrate and pressurizes the first liquid; and an ejection orifice which is formed in the channel forming member and through which the second liquid is ejected in a direction crossing the predetermined direction by pressure received from the first liquid pressurized by the pressure generation element, wherein a length of flow of the second liquid from the second inlet port to a position at which the second liquid is ejectable from the ejection orifice is shorter than a length of flow of the first liquid from the first inlet port to the position at which the second liquid is ejectable.

* * * * *